US009274479B2

(12) United States Patent
Hoshi et al.

(10) Patent No.: US 9,274,479 B2
(45) Date of Patent: Mar. 1, 2016

(54) OPTICAL SENSOR AND IMAGE FORMING APPARATUS CONFIGURED TO DETECT LIGHT REFLECTED FROM SHEET

(75) Inventors: Fumikazu Hoshi, Miyagi (JP); Yoshihiro Ohba, Miyagi (JP)

(73) Assignee: RICOH COMPANY, LTD., Tokyo (JP)

( * ) Notice: Subject to any disclaimer, the term of this patent is extended or adjusted under 35 U.S.C. 154(b) by 555 days.

(21) Appl. No.: 13/298,552

(22) Filed: Nov. 17, 2011

(65) Prior Publication Data

US 2012/0134693 A1 May 31, 2012

(30) Foreign Application Priority Data

Nov. 26, 2010 (JP) ..... 2010-263093
Aug. 1, 2011 (JP) ..... 2011-167948

(51) Int. Cl.
*G03G 15/00* (2006.01)

(52) U.S. Cl.
CPC ..... *G03G 15/5029* (2013.01)

(58) Field of Classification Search
CPC ..... G03G 15/5029; G03G 15/6591; G03G 2215/00616; G03G 2215/00611; G03G 2215/00717; G03G 2215/00738; G03G 2215/00742; G03G 2215/00751; G01N 21/55; B41J 11/0035
USPC ..... 399/45, 16, 23, 49, 60, 301, 74; 356/369, 445
See application file for complete search history.

(56) References Cited

U.S. PATENT DOCUMENTS

| | | | | |
|---|---|---|---|---|
| 5,650,612 | A * | 7/1997 | Criswell et al. | 250/226 |
| 6,731,886 | B2 | 5/2004 | Takeda | |
| 2002/0148943 | A1* | 10/2002 | Tatum et al. | 250/203.1 |
| 2003/0230703 | A1* | 12/2003 | Sugiyama et al. | 250/200 |
| 2004/0008245 | A1* | 1/2004 | Hirai et al. | 347/129 |
| 2005/0117928 | A1* | 6/2005 | Hino | 399/49 |
| 2006/0132523 | A1* | 6/2006 | Xie et al. | 347/16 |
| 2006/0232624 | A1* | 10/2006 | Inoue | 347/23 |
| 2009/0096855 | A1* | 4/2009 | Foo et al. | 347/237 |
| 2010/0254423 | A1 | 10/2010 | Schemmann | |
| 2010/0266302 | A1* | 10/2010 | Suzuki et al. | 399/49 |
| 2011/0228035 | A1 | 9/2011 | Ishii et al. | |
| 2011/0261139 | A1 | 10/2011 | Hoshi et al. | |
| 2011/0267415 | A1 | 11/2011 | Ohba et al. | |

FOREIGN PATENT DOCUMENTS

| | | |
|---|---|---|
| JP | 7-20672 | 1/1995 |
| JP | H9-222361 | 8/1997 |
| JP | H9-282706 | 10/1997 |
| JP | 10-160687 | 6/1998 |
| JP | 11-249353 | 9/1999 |
| JP | 2002-340518 | 11/2002 |

(Continued)

OTHER PUBLICATIONS

Apr. 16, 2012 European search report in connection with counterpart European patent application No. 11 18 9791.

(Continued)

*Primary Examiner* — Billy Lactaoen
(74) *Attorney, Agent, or Firm* — Cooper & Dunham LLP

(57) ABSTRACT

An optical sensor includes an irradiation system including a semiconductor laser having plural light-emitting parts; and at least one photodetector that detects an amount of light which is emitted from the irradiation system and reflected on a sheet-like object.

19 Claims, 23 Drawing Sheets

(56) References Cited

FOREIGN PATENT DOCUMENTS

| | | | |
|---|---|---|---|
| JP | 2003-292170 | | 10/2003 |
| JP | 2004-529346 | | 9/2004 |
| JP | 2005-156380 | | 6/2005 |
| JP | 2005-529313 | | 9/2005 |
| JP | 2006-62842 | | 3/2006 |
| JP | 2006-126281 | | 5/2006 |
| JP | 2008311499 A | * | 12/2008 |
| JP | 2009-40031 | | 2/2009 |

OTHER PUBLICATIONS

Apr. 8, 2015 Japanese official action in corresponding Japanese Patent Application No. 2011-167948.

* cited by examiner

OPTICAL SENSOR AND IMAGE FORMING APPARATUS CONFIGURED TO DETECT LIGHT REFLECTED FROM SHEET

BACKGROUND OF THE INVENTION

1. Field of the Invention

An aspect of this disclosure relates to an optical sensor and an image forming apparatus. Specifically, the aspect of this disclosure relates to an optical sensor including a semiconductor laser and an image forming apparatus including the optical sensor.

2. Description of the Related Art

An image forming apparatus, such as a digital copier or a laser printer, transfers a toner image onto a surface of a recording medium, such as a printing paper. Then the image forming apparatus fixes the toner image by heating and pressing the toner image under a predetermined condition, thereby forming an image.

A fixing property of the toner image is affected to a large degree by a material, a thickness, a degree of humidity, a degree of smoothness, and a coating condition of the recording medium. For example, for a recording medium whose degree of smoothness is low and whose surface has significant irregularities, a fixing ratio at a concave portion is low, and it is possible that an unevenness in color occurs. Therefore, in order to perform a high quality image formation, it may be required to set a fixing condition individually depending on the type of recording medium.

Further, in accordance with the advancement in the image forming apparatus and the diversification in the methods of expression, there are more than several hundred types of recording media only for the printing papers. Furthermore, for each type of the printing paper, there is a wide variety of names depending on the difference in the basis weight or in the thickness.

Types of mainly used printing papers include a regular paper; a coated paper, such as a gloss coated paper, a matt coated paper, and an art paper; a plastic sheet paper; and a specialty paper whose surface is embossed. The names of the above papers are also increasing.

In a present image forming apparatus, a user may be required to set the fixing condition at a time of printing. Therefore, the user may be required to have knowledge for identifying the type of paper. Furthermore, there is a bother such that, each time, the user may be required to enter a content of a setting corresponding to the type of the paper. When an erroneous content of the setting is entered, an optimized image is not obtained.

Incidentally, Patent Document 1 (Japanese Published Unexamined Publication No. 2002-340518) discloses a surface property identifying device that includes a sensor that identifies a surface property of a recording material by scanning the surface of the recording material while contacting the surface of the recording material.

Patent Document 2 (Japanese Published Unexamined Publication No. 2003-292170) discloses a printing device that determines a type of printing paper based on a pressure value, the pressure value being detected with a pressure sensor when the pressure sensor contacts the printing paper.

Patent Document 3 (Japanese Published Unexamined Publication No. 2005-156380) discloses a recording material determining device which determines a type of recording material using reflected light and transmitted light.

Patent Document 4 (Japanese Published Unexamined Publication No. HEI10-160687) discloses a sheet material determining device which determines a material of a sheet under conveyance based on an amount of light reflected on a surface of the sheet material and an amount of light transmitted through the sheet material.

Patent Document 5 (Japanese Published Unexamined Publication No. 2006-062842) discloses an image forming apparatus including determining means for determining whether a recording material is stored in a feeding unit and whether the feeding unit exists, based on a detection output from a reflection-type optical sensor.

Patent Document 6 (Japanese Published Unexamined Publication No. HEI11-249353) discloses an image forming apparatus that determines a surface property of a recording medium by irradiating light to the recording medium and detecting respective amounts of two polarization components of the reflected light.

The recording material determining device disclosed in Patent Document 3, however, can determine only a degree of smoothness of a surface of a printing paper. The recording material determining device does not distinguish between names of printing papers, the names of recording papers having the same degree of smoothness but having different thicknesses. Further, depending on an imaging device that is used in the recording material determining device, a blur occurs on a read image and a high quality image is not obtained. Thus it is difficult to identify the recording material accurately. In order to reduce the blur, a higher performance device may be required, but it is disadvantageous since it leads to a higher cost. Further, even if the high quality image is obtained, there is another disadvantage that a high performance image analyzing device may be required to identify the recording material from the high quality image.

Further, with the sheet material determining device disclosed in Patent Document 4 and with the image forming apparatuses disclosed in Patent Document 5 and Patent Document 6, only differences among non-coated paper/coated paper/OHP sheet can be identified (determined). The sheet material determining device disclosed in Patent Document 4 and the image forming apparatuses disclosed in Patent Document 5 and Patent Document 6 do not distinguish among the names. It may be required to distinguish among the names to form a high quality image.

SUMMARY OF THE INVENTION

In one aspect, there is provided an optical sensor that includes an irradiation system including a semiconductor laser having a plurality of light-emitting parts; and at least one photodetector that detects an amount of light which is emitted from the irradiation system and reflected on a sheet-like object.

In another aspect, there is provided an image forming apparatus that forms an image on a recording medium. The image forming apparatus includes an optical sensor. The optical sensor includes an irradiation system including a semiconductor laser having a plurality of light-emitting parts; and at least one photodetector that detects an amount of light which is emitted from the irradiation system and reflected on the recording medium.

Other objects, features and advantages of embodiments of the present invention will become more apparent from the following detailed description when read in conjunction with the accompanying drawings.

DETAILED DESCRIPTION OF THE EMBODIMENTS

Figure 1:
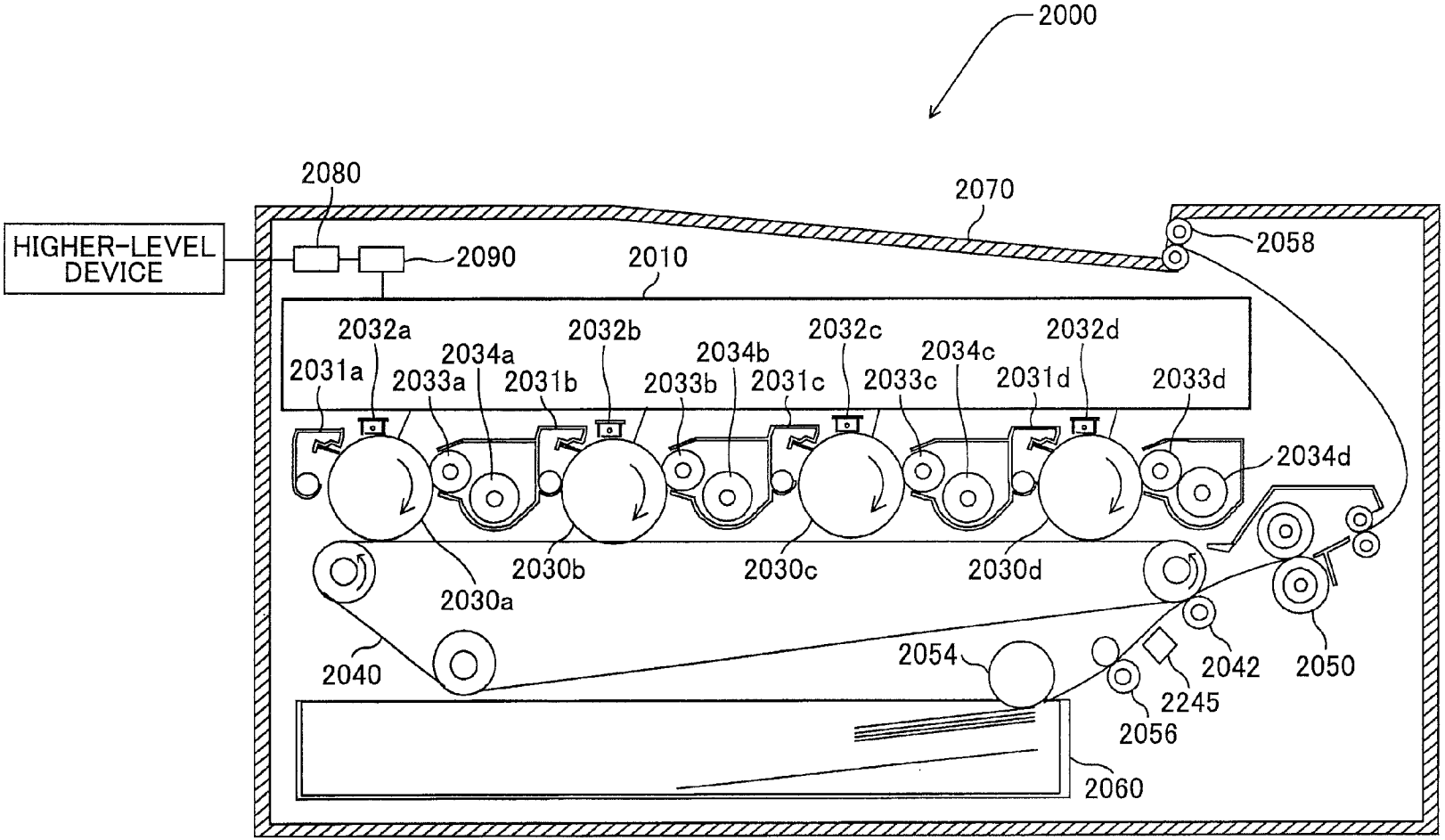
FIG. 1 is a diagram illustrating a schematic configuration of a color printer according to an embodiment of the present invention.

Hereinafter, an embodiment of the present invention is explained based on FIGS. 1-12. FIG. 1 shows a schematic configuration of a color printer 2000 as an image forming apparatus according to the embodiment.

The color printer 2000 is a tandem-type multicolor printer which forms full color images by overlapping four colors (i.e., black, cyan, magenta, and yellow). The color printer 2000 includes an optical scanning device 2010, four photosensitive drums (2030*a*, 2030*b*, 2030*c*, and 2030*d*), four cleaning units (2031*a*, 2031*b*, 2031*c*, and 2031*d*), four charging devices (2032*a*, 2032*b*, 2032*c*, and 2032*d*), four developing rollers (2033*a*, 2033*b*, 2033*c*, and 2033*d*), four toner cartridges (2034*a*, 2034*b*, 2034*c*, and 2034*d*), a transfer belt 2040, a transfer roller 2042, a fixing device 2050, a feeding roller 2054, a pair of registration rollers 2056, an eject roller 2058, a feeding tray 2060, an eject tray 2070, a communication controlling device 2080, an optical sensor 2245, and a printer controlling device 2090 which integrally controls the above units.

The communication controlling device 2080 controls bidirectional communications with a higher-level device (such as a personal computer) through a network.

The printer controlling device 2090 includes a CPU, a ROM which stores programs written with codes that are readable with the CPU and various types of data which are used when the programs are executed, a RAM which is a working memory, and an AD converter circuit which converts analog data to digital data. The printer controlling device 2090 controls respective units in response to a request from the high-level device, and the printer controlling device 2090 transmits image information from the high-level device to the optical scanning device 2010.

The photosensitive drum 2030*a*, the charging device 2032*a*, the developing roller 2033*a*, the toner cartridge 2034*a*, and the cleaning unit 2031*a* are used as a set, and they make up an image formation station (hereinafter, the image formation station is referred to as a "K-station," for convenience) which forms black images.

The photosensitive drum 2030*b*, the charging device 2032*b*, the developing roller 2033*b*, the toner cartridge 2034*b*, and the cleaning unit 2031*b* are used as a set, and they make up an image formation station (hereinafter, the image formation station is referred to as a "C-station," for convenience) which forms cyan images.

The photosensitive drum 2030*c*, the charging device 2032*c*, the developing roller 2033*c*, the toner cartridge 2034*c*, and the cleaning unit 2031*c* are used as a set, and they make up an image formation station (hereinafter, the image formation station is referred to as a "M-station," for convenience) which forms magenta images.

The photosensitive drum 2030*d*, the charging device 2032*d*, the developing roller 2033*d*, the toner cartridge 2034*d*, and the cleaning unit 2031*d* are used as a set, and they make up an image formation station (hereinafter, the image formation station is referred to as a "Y-station," for convenience) which forms yellow images.

A photosensitive layer is formed on a surface of each of the photosensitive drums. Namely, the surfaces of the photosensitive drums are surfaces to be scanned. Here, it is assumed that respective photosensitive drums rotate within the surface of FIG. 1 in directions of arrows by a rotational mechanism not shown in the figures.

The charging devices cause the surfaces of the corresponding photosensitive drums to be uniformly charged.

The optical scanning device 2010 irradiates light fluxes modulated in colors on the surfaces of the corresponding charged photosensitive drums, based on multi-color image information (black image information, cyan image information, magenta image information, and yellow image information) from the higher-level device. This makes charges disappear from portions on the respective surfaces of the photosensitive drums, the portions being irradiated by the light fluxes. In this manner, a latent image corresponding to the image information is formed on each of the surfaces of the photosensitive drums. The latent images formed here move toward directions of the corresponding developing rollers in accordance with rotations of the photosensitive drums.

Incidentally, in each of the photosensitive drums, areas on which image information is written are called "effective scanning areas," "image formation areas," or "effective image areas."

Black toners are stored in the toner cartridge 2034*a* and the black toners are supplied to the developing roller 2033*a*. Cyan toners are stored in the toner cartridge 2034*b* and the cyan toners are supplied to the developing roller 2033*b*. Magenta toners are stored in the magenta toner cartridge 2034*c* and the magenta toners are supplied to the developing roller 2033*c*. Yellow toners are stored in the toner cartridge 2034*d* and the yellow toners are supplied to the developing roller 2033*d*.

The toners from the cartridges are applied thinly and uniformly on the surfaces of the corresponding developing rollers in accordance with rotations of the developing rollers. When the toners on the surface of each of the developing rollers contact the surface of the corresponding photosensitive drum, the toners move only to the portions on the surface of the corresponding photosensitive drum. Then the toners adhere to the portions. Namely, each of the developing rollers causes the toners to be adhered to the latent image formed on the surface of the corresponding photosensitive drum. In this manner, the latent images are exposed. Here, the images on which the toners are adhered (toner images) are moved in the direction of the transfer belt in accordance with rotations of the corresponding photosensitive drum.

The yellow toner image, the magenta toner image, the cyan toner image, and the black toner image are sequentially transferred to the transfer belt 2040 at predetermined timings. A color image is formed by superposing the toner images.

The feeding tray 2060 stores sheets of recording paper. The feeding roller 2054 is placed in the neighborhood of the feeding tray 2060. The feeding roller 2054 takes out the sheets of recording paper from the feeding tray 2060 one by one, and the feeding roller 2054 conveys the sheet of recording paper to the pair of registration rollers 2056. The pair of registration rollers 2056 sends the sheet of recording paper to a nip between the transfer belt 2040 and the transfer roller 2042 at a predetermined timing. In this manner, a color image on the transfer belt 2040 is transferred onto the sheet of recording paper. The sheet of recording paper on which the color image is transferred is sent to the fixing device 2050.

At the fixing device 2050, heat and pressure are applied to the sheet of recording paper. Thus the toners are fixed on the sheet of recording paper. The sheet of recording paper on which the toners are fixed is sent to the eject tray 2070 through the eject roller 2058. Then the sheets of recording paper are sequentially stacked on the eject tray 2070.

The cleaning units remove the toners remaining on the surfaces of the corresponding photosensitive drums (residual toners). The surfaces of the photosensitive drums, from which the residual toners are removed, return to positions where the surfaces are facing the corresponding charging devices again.

The optical sensor 2245, for example, is placed in the neighborhood of a conveyance path. Here, through the conveyance path, the sheet of recording paper taken out from the feeding tray 2060 is conveyed prior to receiving the toner image.

Figure 2A:
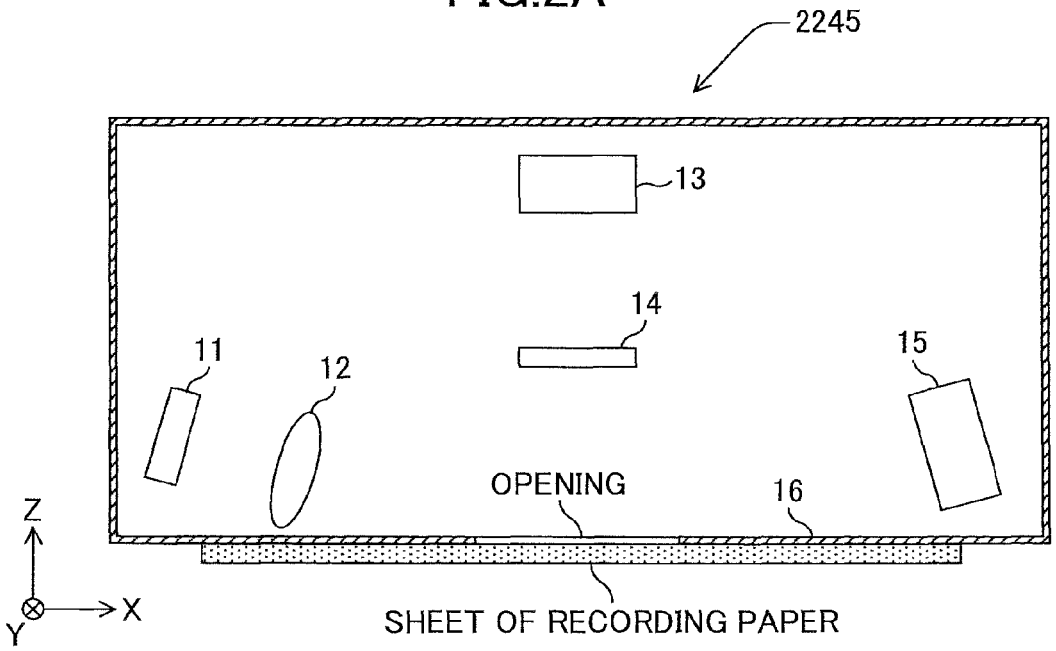
FIG. 2A is a diagram illustrating a configuration of an optical sensor in FIG. 1.
Figure 2B:
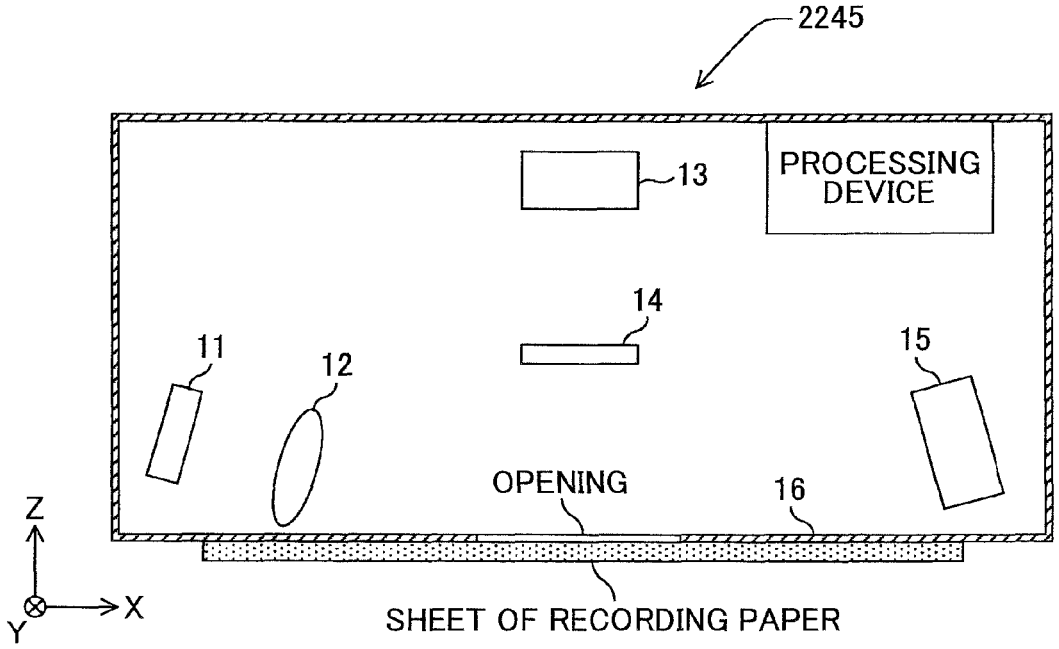
FIG. 2B is a diagram illustrating another configuration of the optical sensor in FIG. 1.

As shown in FIG. 2A, for example, the optical sensor 2245 includes a light source 11, a collimation lens 12, two optical receivers (13, 15), a polarization filter 14, and a dark box 16 which stores the above elements.

The dark box 16 is a box member made of metal. For example, the dark box 16 is a box member made of aluminum. In order to reduce effects of ambient light and stray light, a black alumite treatment is performed on the interior surface of the dark box 16.

Here, in the XYZ-three dimensional orthogonal coordinate system, it is assumed that the direction perpendicular to the surface of the sheet of recording paper is Z-axis direction and the surface parallel to the surface of the sheet of recording paper is XY plane. Further, it is assumed that the optical sensor 2245 is placed at the positive Z side of the sheet of recording paper.

Figure 3:
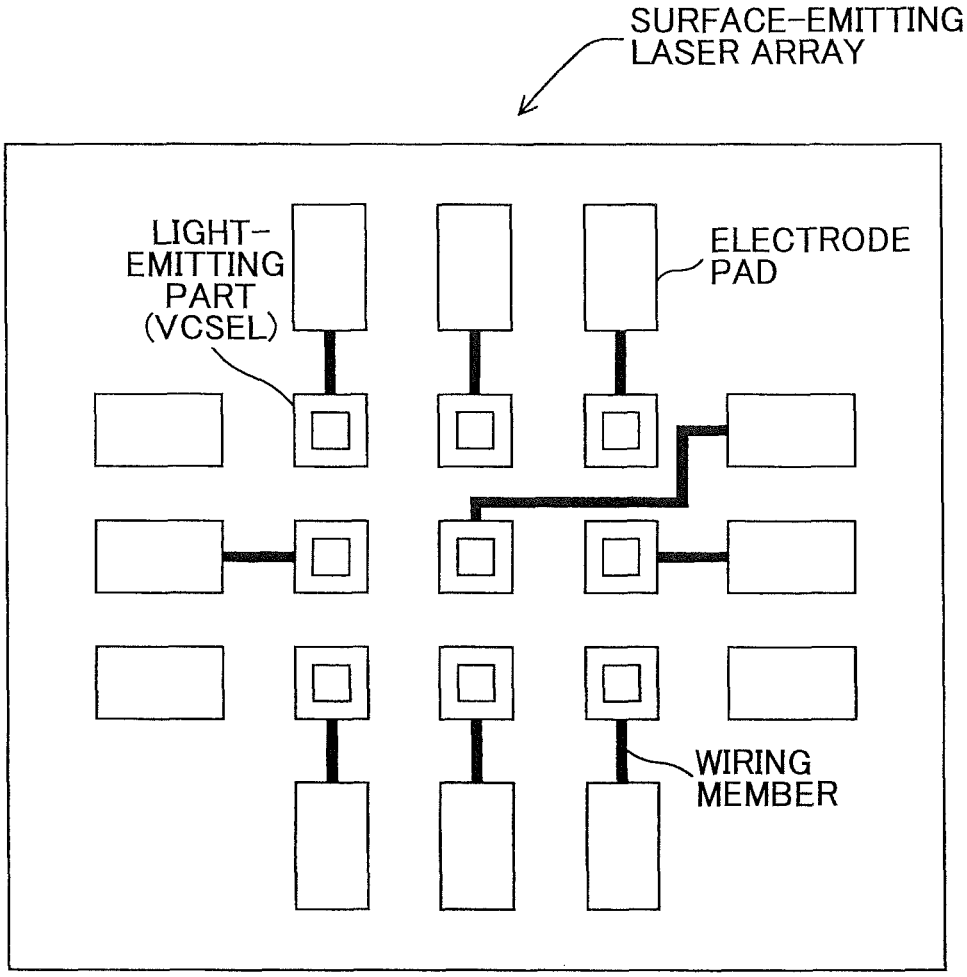
FIG. 3 is a diagram illustrating a surface-emitting laser array.
Figure 4:
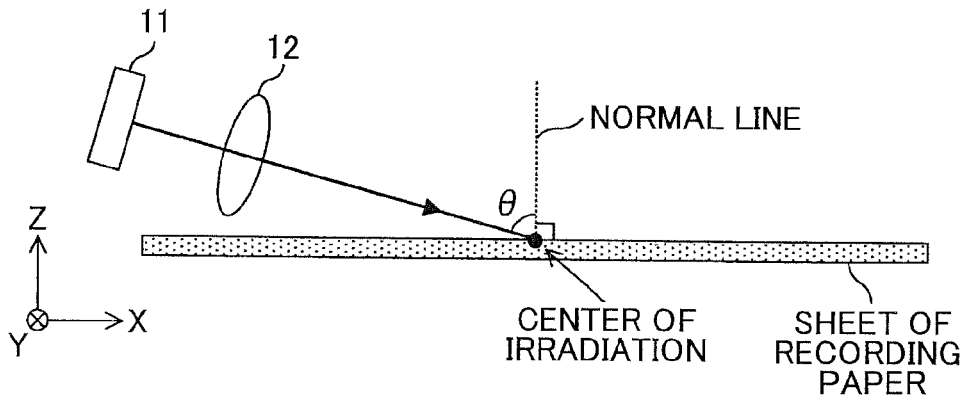
FIG. 4 is a diagram illustrating an incident angle of entering light.

The light source 11 includes plural light-emitting parts. The light-emitting parts are vertical-cavity surface-emitting lasers (Vertical Cavity Surface Emitting Laser: VCSEL) which are formed on a same substrate. Namely, the light source 11 includes a surface-emitting laser array (VCSEL array). Here, for example, as shown in FIG. 3, 9 light-emitting parts (ch1-ch9) are arranged in two dimensions.

The light source 11 is arranged so that the sheet of recording paper is irradiated by s-polarized light. Further, an incident angle θ (cf. FIG. 4) of light flux from the light source 11 on the sheet of recording paper is 60 degrees. Further, in FIG. 4, the dark box 16 is not shown in the figure for clarity.

The collimation lens 12 is placed on a light path of the light flux emitted from the light source 11. The collimation lens 12 causes the light flux to be substantially parallel light. Here, the width of the light flux transmitted from the collimation lens 12 is 4 mm. The light flux having passed through the collimation lens 12 passes through an opening arranged in the dark box 16, and irradiates the sheet of recording paper. Hereinafter, a center of an irradiated area on the surface of the sheet of recording paper is abbreviated as "center of irradiation."

Incidentally, when a light beam enters a boundary surface of a medium, the surface including the entering light beam and a normal line of the boundary surface at the entering point is called an "incidence plane." Thus, when the entering light beam includes plural light beams, there exist incidence planes for the respective light beams. Here, however, for the sake of simplicity, the incidence plane for the light beam entering the center of irradiation is referred to as the incidence plane for the sheet of recording paper. Namely, the plane including the center of irradiation and parallel to the XZ plane is the incidence plane for the sheet of recording paper.

The polarization filter 14 is placed at the positive Z side of the center of irradiation. The polarization filter 14 is a polarization filter such that it causes a P-polarization light to be passed through and an S-polarization light to be blocked. Further, instead of the polarization filter 14, a polarizing beamsplitter having an equivalent function can be used.

Figure 5:
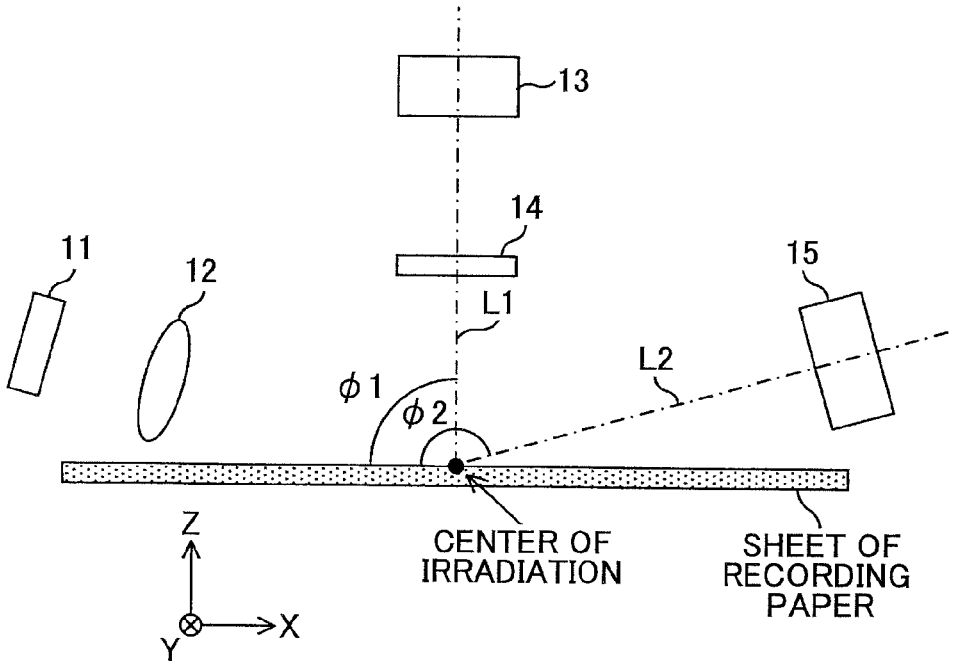
FIG. 5 is a diagram illustrating positions where two light receivers are arranged.
Figure 6A:
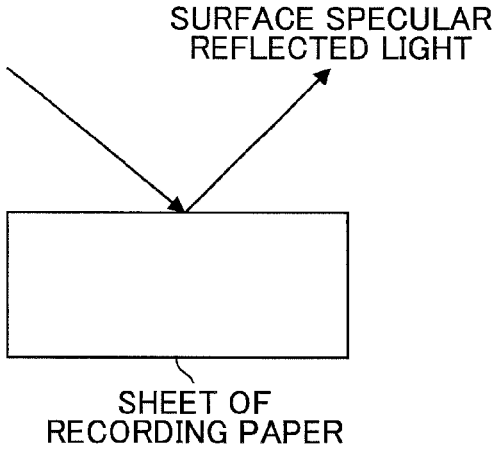
FIG. 6A is a diagram illustrating surface specular reflected light.
Figure 6B:
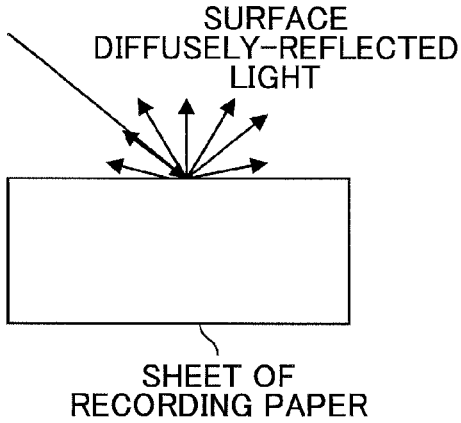
FIG. 6B is a diagram illustrating surface diffusely-reflected light.
Figure 6C:
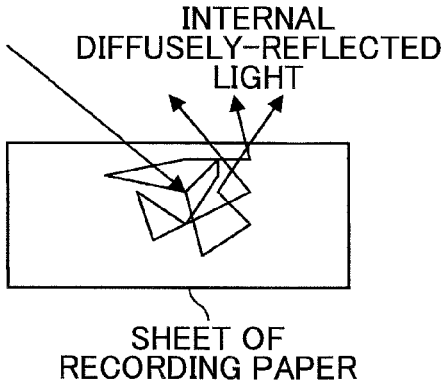
FIG. 6C is a diagram illustrating internal diffusely-reflected light.
Figure 7:
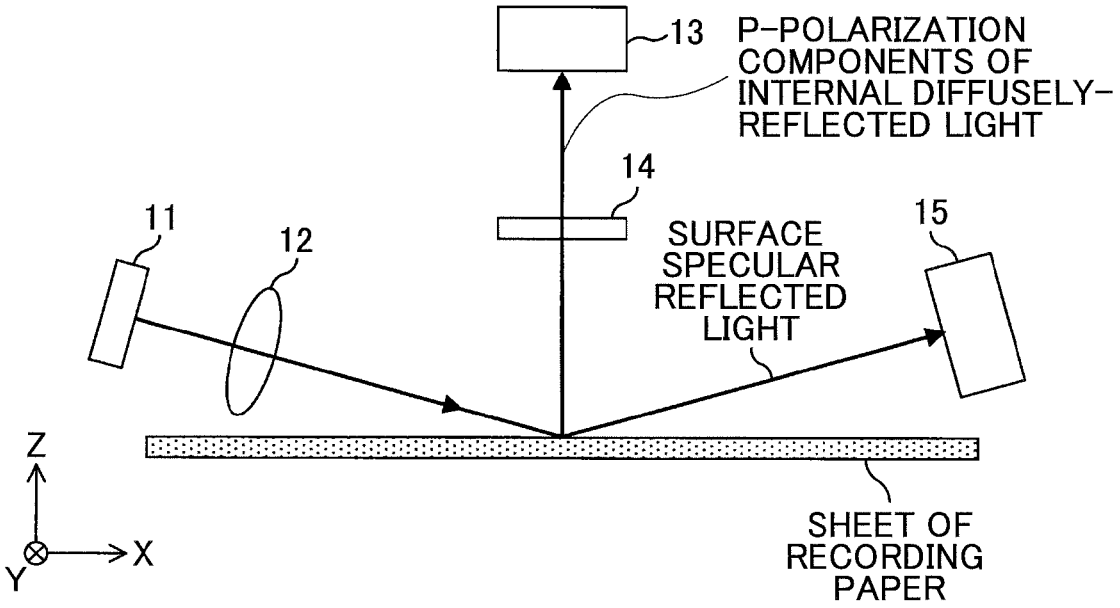
FIG. 7 is a diagram illustrating light received with the respective optical receivers.

The optical receiver 13 is placed at the positive Z side of the polarization filter 14. Here, as shown in FIG. 5, an angle $\phi 1$ between a line L1 and the surface of the sheet of recording paper is 90 degrees. Here, the line L1 connects the center of irradiation, the polarization filter 14, and the optical receiver 13.

The optical receiver 15 is placed at the positive X side of the center of irradiation with respect to the X-axis direction. An angle $\phi 2$ between a line L2 and the surface of the sheet of recording paper is 150 degrees. Here, the line L2 connects the center of irradiation and a center of the optical receiver 15.

Namely, the center of the light source 11, the center of the polarization filter 14, and the centers of the optical receivers 13 and 15 exist within the incidence plane of the sheet of recording paper.

Incidentally, when the sheet of recording paper is irradiated, it is possible to consider that a reflected light beam from the sheet of recording paper is decomposed into a reflected light beam which is reflected on the surface of the sheet of recording paper and a reflected light beam which is reflected inside of the sheet of recording paper. Further, it is possible to consider that the reflected light beam reflected on the surface of the sheet of recording paper is decomposed into a reflected light beam which is reflected regularly (specular reflection) and a reflected light beam which is diffusely reflected. Hereinafter, the reflected light beam which is reflected regularly on the surface of the sheet of recording paper is referred to as "a surface specular reflected light beam," and the reflected light beam which is diffusely-reflected is referred to as "a surface diffusely-reflected light beam" (cf. FIG. 6A and FIG. 6B).

The surface of the sheet of recording paper includes a planar portion and a slanted portion. The degree of smoothness of the surface of the sheet of recording paper is determined by a ratio between the planar portion and the slanted portion. A light beam reflected at the planar portion becomes the surface specular reflected light beam, and a light beam reflected at the slanted portion becomes the surface diffusely-reflected light beams. The surface diffusely-reflected light beams are reflected light beams that are completely diffusely reflected. Thus it can be deemed that reflection directions of the surface diffusely-reflected light beam are isotropic. Further, an amount of the surface specular reflected light beam increases as the degree of smoothness becomes higher.

On the other hand, when the sheet of recording paper is a usual printing paper, the reflected light beam is multiplied and scattered by fibers inside of the sheet of recording paper. Thus the reflected light beams which are reflected inside of the sheet of recording paper include only the diffusely-reflected light beams. Hereinafter, the reflected light beam from inside of the sheet of recording paper is also referred to as "an internal diffusely-reflected light beam," for the sake of simplicity (cf. FIG. 6C). As with the surface diffusely-reflected light beam, the internal diffusely-reflected light beam is completely diffusely reflected. Thus it can be deemed that reflection directions of the internal diffusely-reflected light beams are isotropic.

Polarization directions of the surface specular reflected light beam and the surface diffusely-reflected light beam are the same as a polarization direction of the entering light beam. Incidentally, in order that the polarization direction rotates on the surface of the sheet of recording paper, it is required that the entering light beam be reflected on a surface, the surface being slanted in the direction of the rotation with respect to an optical axis of the entering light beam. Here, since the light source, the center of irradiation, and the optical receiver are placed within the same plane, the reflected light beam, for which the polarization direction rotates, is not reflected in the direction of the optical receiver.

On the other hand, a polarization direction of the internal diffusely-reflected light beam rotates from the polarization direction of the entering light beam. It is considered that the internal diffusely-reflected light beam optically rotates, when the internal diffusely-reflected light beam transmits in the fibers and is multiplied and diffusely reflected. Thus the polarization direction rotates.

The surface diffusely-reflected light beams and the internal diffusely-reflected light beams enter the polarization filter 14. Since the polarization direction of the surface diffusely-reflected light beam is S-polarized light similar to the polarization direction of the entering light beam, the surface diffusely-reflected light beam is blocked by the polarization filter 14. On the other hand, since the polarization direction of the internal diffusely-reflected light beam is rotated from the polarization direction of the entering light beam, P-polarized light components included in the internal diffusely-reflected light beam transmit through the polarization filter 14. Namely, P-polarized light components included in the internal diffusely-reflected light beam are received by the optical receiver 13 (cf. FIG. 7).

The inventors have confirmed that an amount of the P-polarized light components included in the internal diffusely-reflected light beam is closely correlated with thickness and density of the sheet of recording paper. This is because the amount of the P-polarized light components depends on a path length of the internal diffusely-reflected light beam, when the internal diffusely-reflected light beam transmits in the fibers in the sheet of recording paper.

The surface specular reflected light beams and very small portions of the surface diffusely-reflected light beams and the internal diffusely-reflected light beams enter the optical receiver 15. Namely, mainly the surface specular reflected light beams enter the optical receiver 15.

The optical receiver 13 and the optical receiver 15 output electric signals corresponding to the received amounts of light received by the optical receiver 13 and the optical receiver 15, respectively, to the printer controlling device 2090. Hereinafter, a signal level of the output signal from the optical receiver 13 is referred to as "S1," and a signal level of the output signal from the optical receiver 15 is referred to as "S2," when the light flux from the light source irradiates the sheet of the recording paper.

Figure 8:
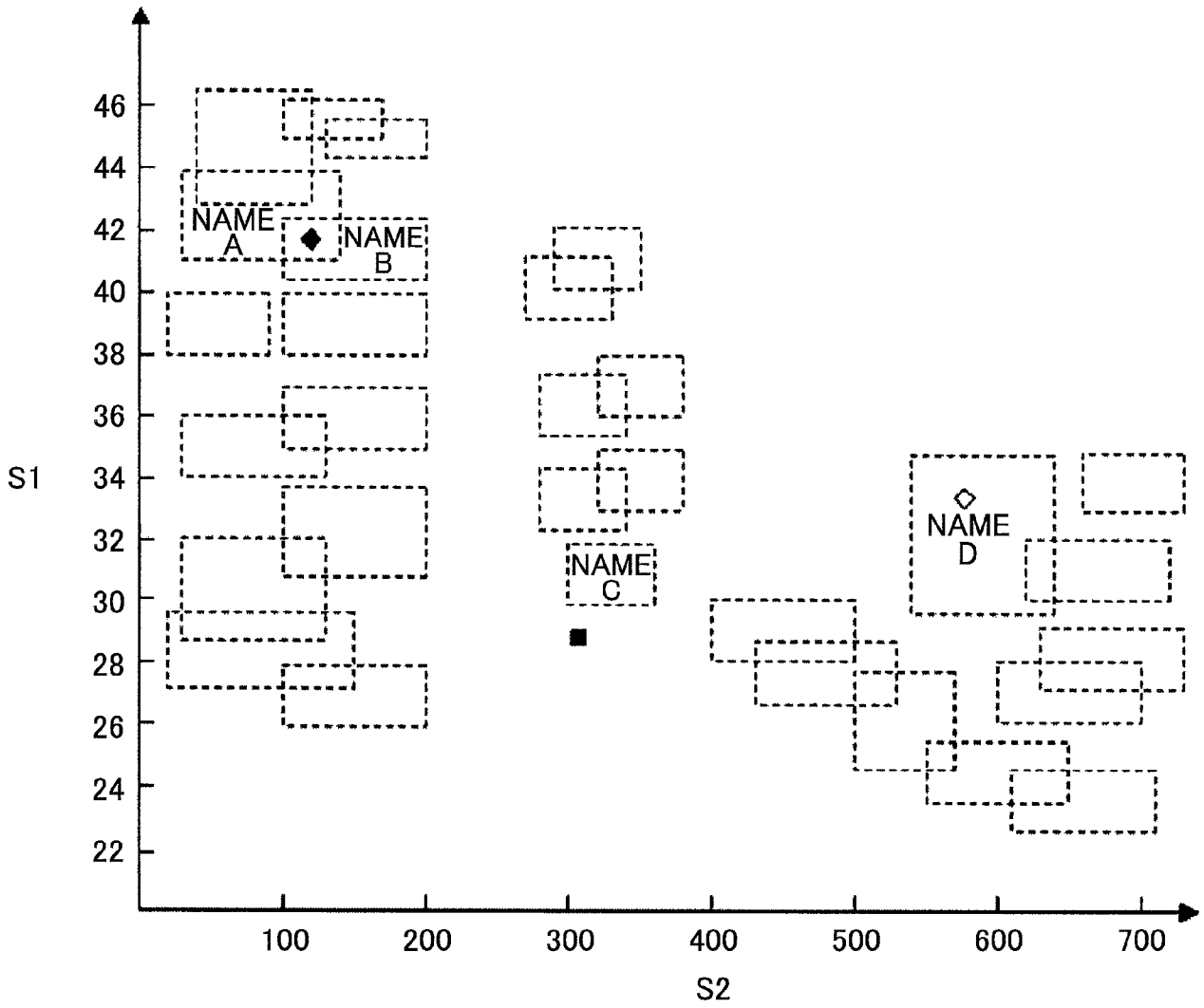
FIG. 8 is a diagram illustrating a relationship between a pair S1 and S2 and a name of a sheet of recording paper.

Here, with respect to plural names of sheets of recording paper, which the color printer 2000 can handle, values of S1 and S2 are measured in advance for respective names of sheets of recording paper at a pre-shipment process, such as an adjustment process. The measured results are stored in the ROM of the printer controlling device 2090 as "a table of determining sheets of recording paper." FIG. 8 shows the measured values of S1 and S2 for 30 names of sheets of recording paper sold within the country. Here, a frame in FIG. 8 shows a range of variations of the same name. For example, when the measured values of S1 and S2 are "◇," it is determined that the name of the sheet of recording paper is the name D. Further, when the measured values of S1 and S2 are "■," it is determined that the name of the sheet of recording paper is the name C, which is the closest name. Further, when the measured values of S1 and S2 are "◆," it is considered that the name of the sheet of recording paper is the name A or the name B. In this case, for example, a difference between the averaged values of the name A and the measured values and a difference between the averaged values of the name B and the measured values are calculated. Then it is determined that the name of the sheet of recording paper is the one of the name A and the name B, whose calculated difference is the smaller of the two.

Conventionally, a glossiness of the surface of a sheet of recording paper has been detected from an amount of specular reflected light. Then a degree of smoothness of the sheet of recording paper has been determined from a ratio between the amount of the specular reflected light and an amount of diffusely-reflected light. In this manner, it has been tried to identify the sheet of recording paper. In contrast, in the embodiment, not only the glossiness and the degree of smoothness of the sheet of recording paper, but also information containing thickness and density, the thickness and the density being other characteristics of the sheet of recording paper, is detected from the reflected light. In this manner, types (names) of the sheets of recording paper that can be identified are extended. For example, it has been difficult to distinguish a normal sheet of paper and a matt coated paper only with information of the surface of the sheet of recording paper, the information of the surface of the sheet of recording paper having been used in a conventional identifying method. In the embodiment, information of the inside of the sheet of recording paper is added to the information of the surface of the sheet of recording paper. With this, it is possible to distinguish between the normal sheet of paper and the matt coated paper. Furthermore, it is possible to distinguish plural names of normal sheets of paper, and it is possible to distinguish plural names of matt coated papers.

Further, identity validation has been performed for about 50 types of printing papers using this method. It has been confirmed that the level of identification has been improved from a level at which non-coated paper/coated paper/OHP sheets are identified, to another level at which the name of the printing paper can be identified.

Further, with respect to the plural names of sheets of recording paper, which the color printer 2000 can handle, the optimum fixing conditions are determined for the respective names of the sheets of recording paper at a pre-shipment process, such as an adjustment process. The results of the determinations are stored in the ROM of the printer controlling device 2090 as "a fixing table."

When the CPU of the printer controlling device 2090 receives a print request from a user, the CPU of the printer controlling device 2090 causes the plural light-emitting parts of the optical sensor 2245 to be simultaneously lighted, and the CPU of the printer controlling device 2090 calculates the values of S1 and S2 from the output signals being output from the optical receiver 13 and the optical receiver 15, respectively.

Then the CPU refers to the table of determining sheets of recording paper and identifies the name of the sheet of the recording paper based on the obtained values of S1 and S2.

Subsequently, the CPU refers to the fixing table and obtains the optimum fixing conditions for the identified name of the sheet of recording paper. Then the CPU controls the fixing device in accordance with the optimum fixing conditions. With this, a high quality image is formed on the sheet of recording paper.

Here, a method of controlling a speckle pattern is explained.

When a semiconductor laser is used as a light source of a sensor detecting a surface condition of the sheet of recording paper based on an amount of reflected light, coherent light beams emitted from the semiconductor laser are diffusely reflected at each point on a rough surface, such as the surface of the sheet of recording paper, and the reflected light beams mutually interfere. In this manner, a speckle pattern is generated.

Figure 9:
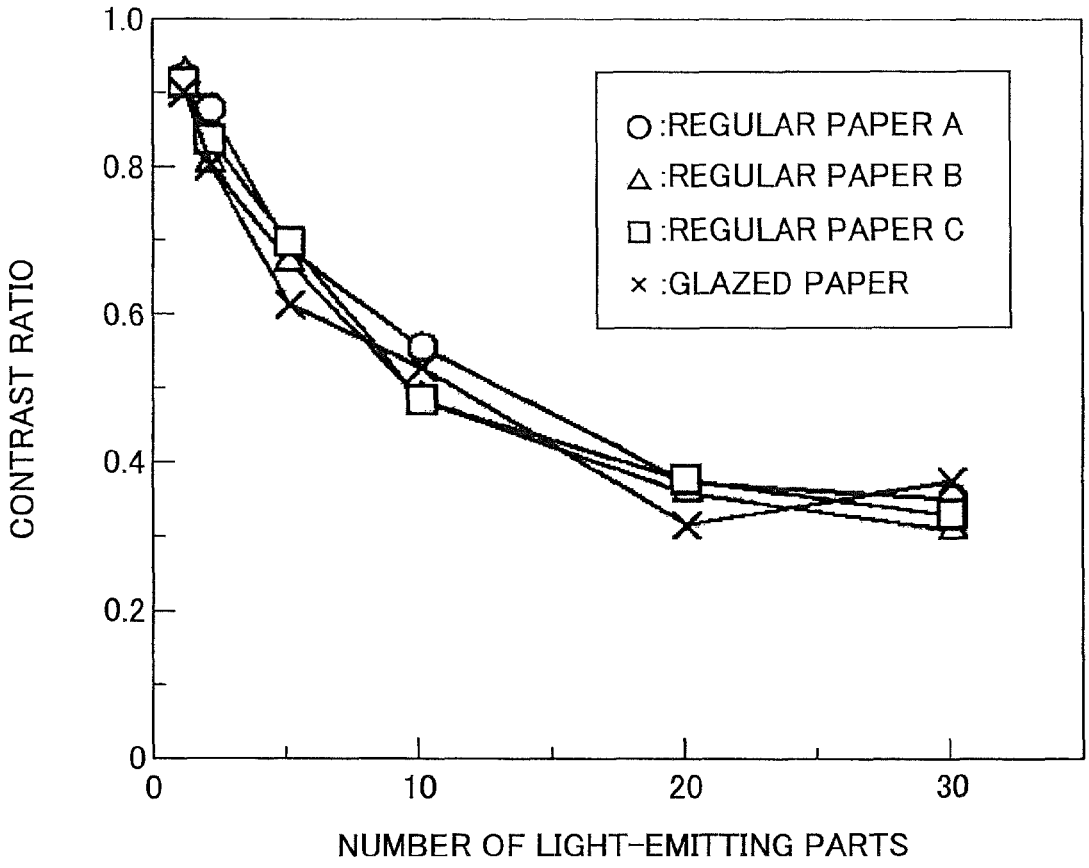
FIG. 9 is a diagram illustrating an influence of a number of light-emitting parts on a contrast ratio of a speckle pattern.

The inventors have obtained a relationship between the number of light-emitting parts and a contrast ratio of the speckle pattern using a vertical-cavity surface-emitting laser array (VCSEL array), in which plural light-emitting parts are two-dimensionally arranged, as a light source (cf. FIG. 9). Here, the contrast ratio of the speckle pattern is defined to be a value which is a normalized difference between a maximum value and a minimum value in an observed intensity of the speckle pattern.

Speckle patterns are observed using a beam profiler with respect to the Y-axis direction (diffusion direction). Then the contrast ratios of the speckle patterns are calculated from the observational results that are obtained using the beam profiler. Three types of regular papers having mutually different degrees of smoothness (regular paper A, regular paper B, and regular paper C) and a glazed paper are used as samples. The regular paper A is a regular paper having an Oken-type smoothness of 33 seconds. The regular paper B is a regular paper having an Oken-type smoothness of 50 seconds. The regular paper C is a regular paper having an Oken-type smoothness of 100 seconds.

It can be understood from FIG. 9 that the contrast ratio of the speckle pattern tends to be reduced as the number of the light-emitting parts are increased. Further, it can be understood that the tendency does not depend on a type of paper.

Figure 10:
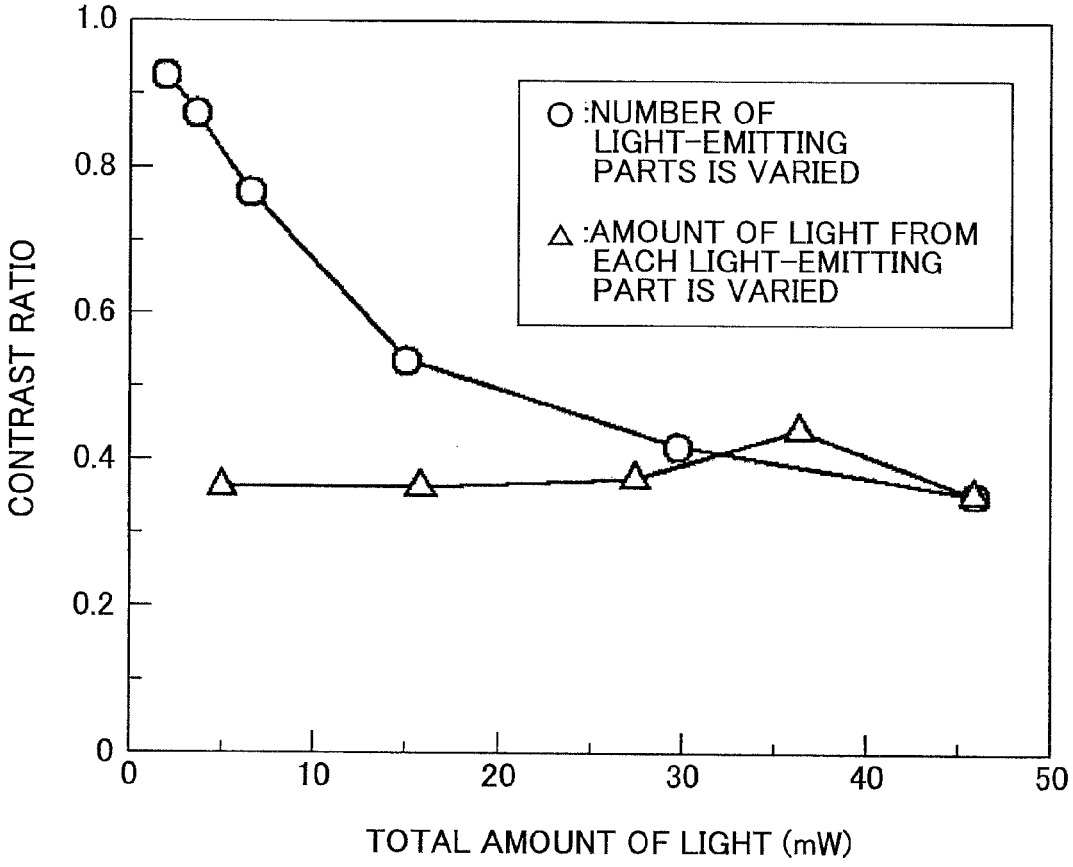
FIG. 10 is a diagram illustrating a relationship between the contrast ratio of the speckle pattern and a total light amount, for a case when the number of the light-emitting parts is varied, and for a case when an amount of light from each light-emitting part is varied.

Further, the inventors have performed experiments to confirm that the effect of reducing the contrast ratio of the speckle pattern does not depend on an increase in a total amount of light, but the effect depends on an increase in the number of the light-emitting parts (cf. FIG. 10).

FIG. 10 shows variation of the contrast ratio with respect to the total amount of light for a case in which the amount of light from each light-emitting part is kept constant (1.66 mW) but the number of the light-emitting parts are varied, and for a case in which the number of the light-emitting parts are fixed at 30 but the amount of light from each light-emitting part is varied.

When the number of the light-emitting parts is fixed and the amount of light from each light-emitting part is varied, the contrast ratio is constant, irrespectively of the amount of light. On the other hand, when the number of the light-emitting parts is varied, the contrast ratio is large when the amount of light is little, that is, when the number of the light-emitting parts is small, and the contrast ratio is reduced as the number of the light-emitting parts is increased. It can be confirmed from the above that the reduction effect of the contrast ratio of the speckle pattern does not depend on the increase in the amount of light, but the reduction effect depends on the increase in the number of the light-emitting parts.

Further, the inventors have examined whether it is possible to suppress the speckle pattern by varying a wavelength of the light emitted from the light source with respect to time.

In a surface-emitting laser (VCSEL), it is possible to control the wavelength of emitted light with a driving current. This is because when the driving current changes, a refractive index is varied by heat inside of the surface-emitting laser and an effective length of a resonator changes.

Figure 11:
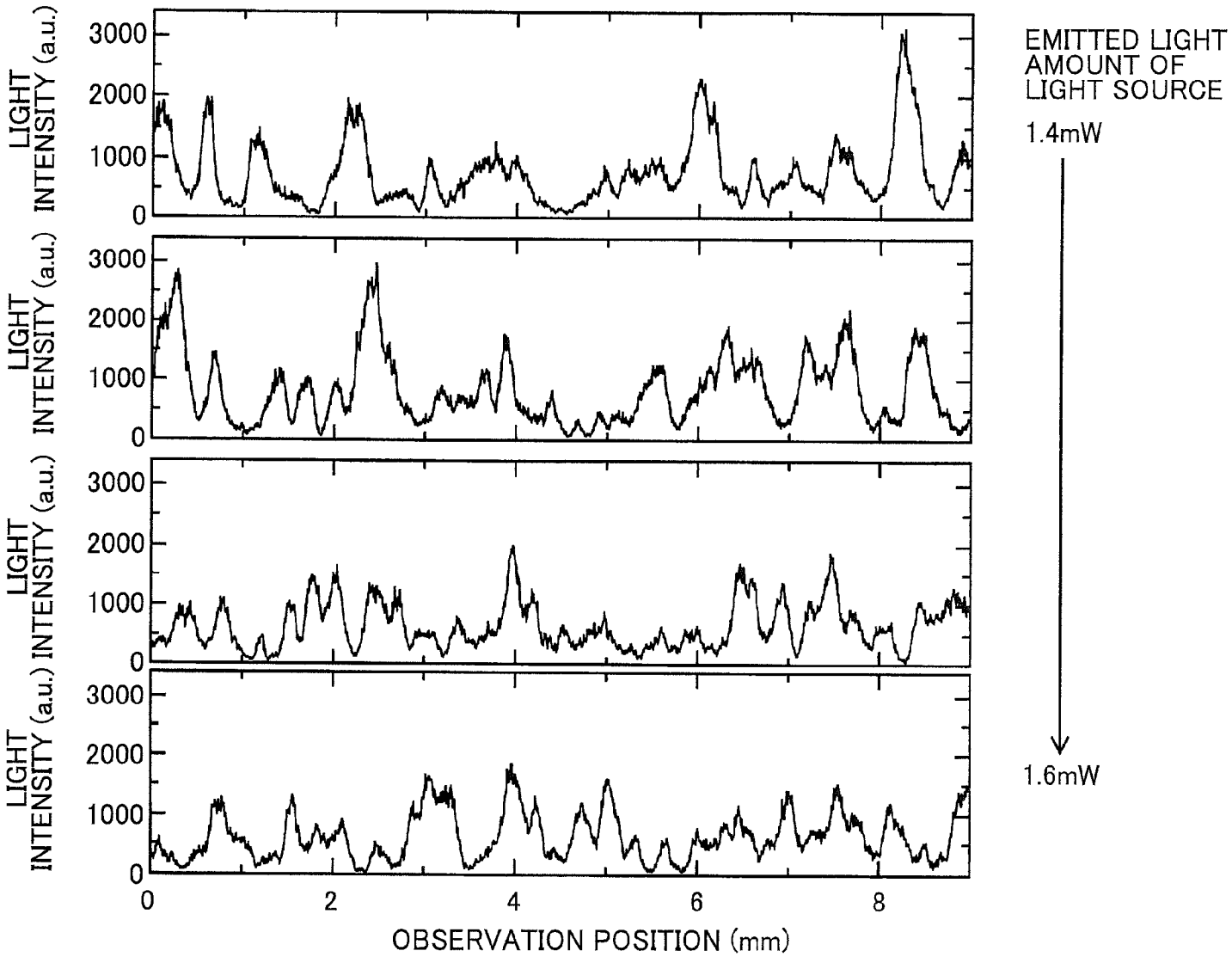
FIG. 11 is a diagram illustrating light intensity distributions of the speckle pattern when a driving current of a light source is varied.

FIG. 11 shows light intensity distributions that were obtained by observing the speckle pattern with the beam profiler, when the amount of emitted light is varied from 1.4 mW to 1.6 mW by changing the driving current of the light source 11. It can be confirmed from FIG. 11 that the wavelength of the light emitted from the light source 11 varies and the light intensity distribution varies as the driving current changes.

Figure 12:
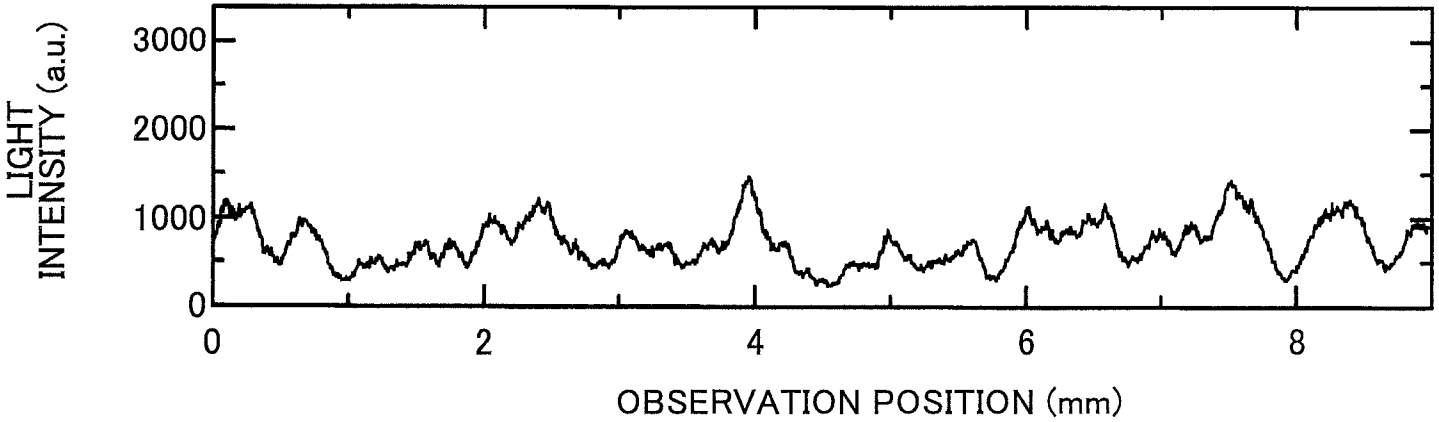
FIG. 12 is a diagram illustrating an effective light intensity distribution of the speckle pattern when the driving current of the light source is rapidly varied.

FIG. 12 shows an effective light intensity distribution when the driving current is rapidly varied. The light intensity distribution is equivalent to the average value of the light intensity distributions for the plural driving currents that are shown in FIG. 11. When the driving current is varied in this manner, the contrast ratio of the speckle pattern is 0.72, and this contrast ratio is reduced from the contrast ratio of the speckle pattern, that is 0.96, when the driving current is kept constant.

Therefore, it is possible to reduce the contrast ratio by setting the driving current of the surface-emitting laser to be a driving current whose current value varies with respect to time, such as a driving current having a triangular waveform.

In the embodiment, the light source 11 of the optical sensor 2245 includes a surface-emitting laser array, in which 9 of the light-emitting parts are arranged two-dimensionally, and the CPU of the printer controlling device 2090 supplies a driving current having a triangular waveform to the surface-emitting laser array. This suppresses the speckle pattern, and an accurate detection of an amount of reflected light is possible. Further, identification precision for the sheet of recording paper can be improved. Namely, it is found that the speckle pattern is suppressed when the wavelength of the emitted light is varied with respect to time.

Further, when the surface-emitting laser array is used, it is easy to adjust irradiated light beams to be parallel beams. Thus it is possible to reduce size and cost of the optical sensor.

Incidentally, it has been confirmed that an amount of the P-polarized light components included in the internal diffusely-reflected light is very small compared to an amount of light irradiated onto the sheet of recording paper (irradiated light amount). For example, when an incident angle θ is 80 degrees, the amount of the internal diffusely-reflected light is about 0.05% of the irradiated light amount. The amount of the P-polarized light components included in the internal diffusely-reflected light is less than or equal to half of the amount of the internal diffusely-reflected light.

Therefore, it is preferable from the viewpoint of precision that detection of the P-polarized light components included in the internal diffusely-reflected light be performed under a condition such that light is irradiated from the light source at high power, the reflected light is accurately received, and a detection amount is maximized.

In order to detect the P-polarized light components included in the internal diffusely-reflected light accurately, the following can be performed.

(1) The detection of the P-polarized light components included in the internal diffusely-reflected light is not performed at least in a direction in which the surface specular reflected light is included.

Actually, it is difficult to completely arrange for the irradiated light to only contain the S-polarized light. Thus the light reflected on the surface includes the P-polarized light components. Therefore, in the direction in which the surface specular reflected light is included, the P-polarized light components originally contained in the irradiated light and reflected on the surface are larger than the P-polarized light components included in the internal diffusely-reflected light. Thus, if the polarization filter 14 and the optical receiver 13 are placed in the direction in which the surface specular reflected light is included, the amount of the reflected light, the reflected light including information about the inside of the sheet of recording paper, is not accurately detected.

A polarization filter with a high extinction ratio can be used so that the irradiated light only contains the S-polarized light. However, this leads to a high cost.

(2) The detection of the P-polarized light components included in the internal diffusely-reflected light is performed in the normal direction at the center of irradiation on the sheet of recording paper.

This is because the amount of the reflected light is the largest in the normal direction of the center of irradiation. Since the internal diffusely-reflected light can be deemed to be perfectly diffusely-reflected light, the amount of the reflected light with respect to the detection direction can be approximated with the Lambertian distribution. Thus the amount of the reflected light is the largest in the normal direction at the center of irradiation. When the polarization filter 14 and the optical receiver 13 are placed in the normal direction at the center of irradiation, the S/N is high and the precision is the highest.

In the method of identifying the sheet of recording paper in the embodiment, a paper type identifying method based on an amount of internal optically rotated light, the internal optically rotated light including information about the inside of the paper, is newly introduced. The internal optically rotated light has not been separately detected before. By detecting a polarization direction at an appropriate position, which is appropriate from the viewpoint of the information of the sheet of recording paper that is included in the polarized components of the diffusion light, information about the thickness and the density can be obtained, in addition to the information about glossiness (smoothness) of the surface of paper. Thus the name identification level is improved and a finer identification is possible.

However, with the surface property identification device disclosed in Patent Document 1 and the printing device disclosed in Patent Document 2, it is possible that the surface of the recording material is damaged and the surface characteristic itself is changed.

Incidentally, it is preferable to use a semiconductor laser as a light source in a sensor that detects the surface condition of a printing paper from the amount of reflected light, so as to improve the S/N. In this case, the speckle pattern is generated when a light flux is irradiated on a rough surface, such as the surface of the printing paper. The speckle pattern varies depending on a portion which is irradiated with the light flux. This can be a cause of a variation of the detected light at the optical receiver and leads to a degradation of the identification precision. Therefore, in general, an LED has been used as a light source.

As explained above, the optical sensor 2245 according to the embodiment includes the light source 11, the collimation lens 12, two optical receivers (13, 15), the polarization filter 14, and the dark box 16 that stores the above elements.

The optical receiver 13 is arranged to receive the P-polarized components included in the internal diffusely-reflected light. The optical receiver 15 is arranged to mainly receive the surface specular reflected light.

In this case, it is possible to identify the name of the sheet of recording paper based on the output signal from the optical receiver 13 and the output signal from the optical receiver 15.

Since the light source includes the plural light-emitting parts, the amount of the P-polarized light components included in the internal diffusely-reflected light is enlarged. Further, the contrast ratio of the speckle pattern is reduced compared to the case when the light source includes only one light-emitting part. Therefore, the identification precision is improved.

Thus the names of the sheet of recording paper can be identified without leading to a higher cost and a growth in size.

Further, since the current, whose current value varies with respect to time, is used as the driving current of the surface emitting laser, the contrast ratio of the speckle pattern is additionally reduced.

Further, since the surface-emitting laser array is used as the light source, a polarization filter for linearly polarizing the irradiated light is not required. The irradiated light can be easily set to be collimated light. Also, due to the downsizing of the surface-emitting laser array, the light source having plural light-emitting parts can be realized. Therefore, a downsizing and a cost reduction of the optical sensor can be planned.

Additionally, the color printer 2000 according to the embodiment includes the optical sensor 2245. Consequently, a high quality image can be formed without leading to a high cost and a growth in size.

In the above described embodiment, the case when the light irradiated onto the sheet of recording paper is the S-polarized light is explained. However, the embodiment is not limited to this case, and the light irradiated to the sheet of recording paper can be the P-polarized light. In this case, however, a polarization filter that transmits the S-polarized light is used, instead of the above described polarization filter 14.

Figure 13:
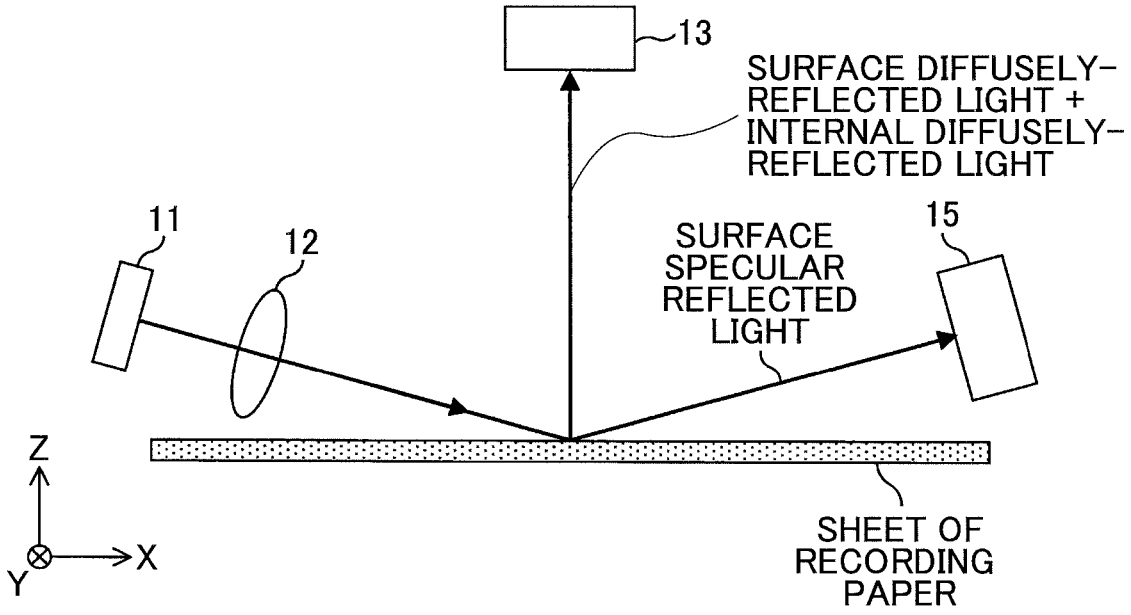
FIG. 13 is a diagram illustrating a modified example of the optical sensor.

Further, in the above described embodiment, when the level at which the optical sensor 2245 identifies the sheet is sufficient to be the level at which the non-coated paper/coated paper/OHP sheet are identified, the above described polarization filter 14 is not required as shown in FIG. 13. The CPU of the printer controlling device 2090 identifies whether the sheet of recording paper is any of the non-coated paper/coated paper/OHP sheet based on the ratio between S1 and S2. In this case, when the surface-emitting laser array is used, a greater amount of light can be irradiated onto the sheet of recording paper. Thus the S/N in the amount of the reflected light is improved and the identification precision is improved. Further, the contrast ratio of the speckle pattern can be reduced by simultaneously lighting the plural the light-emitting parts. Therefore, the amount of the reflected light can be more accurately detected and the identification precision is improved. Further, when the surface-emitting laser array is used, a high-density integration having been difficult for the LED is possible. Thus all the laser beams can be focused at the neighborhood of the optical axis of the collimation lens. Additionally, it is possible to set plural light fluxes to be parallel by setting the incident angles of the laser beams to be a constant angle. Therefore, a collimation optical system can be easily realized.

Figure 14:
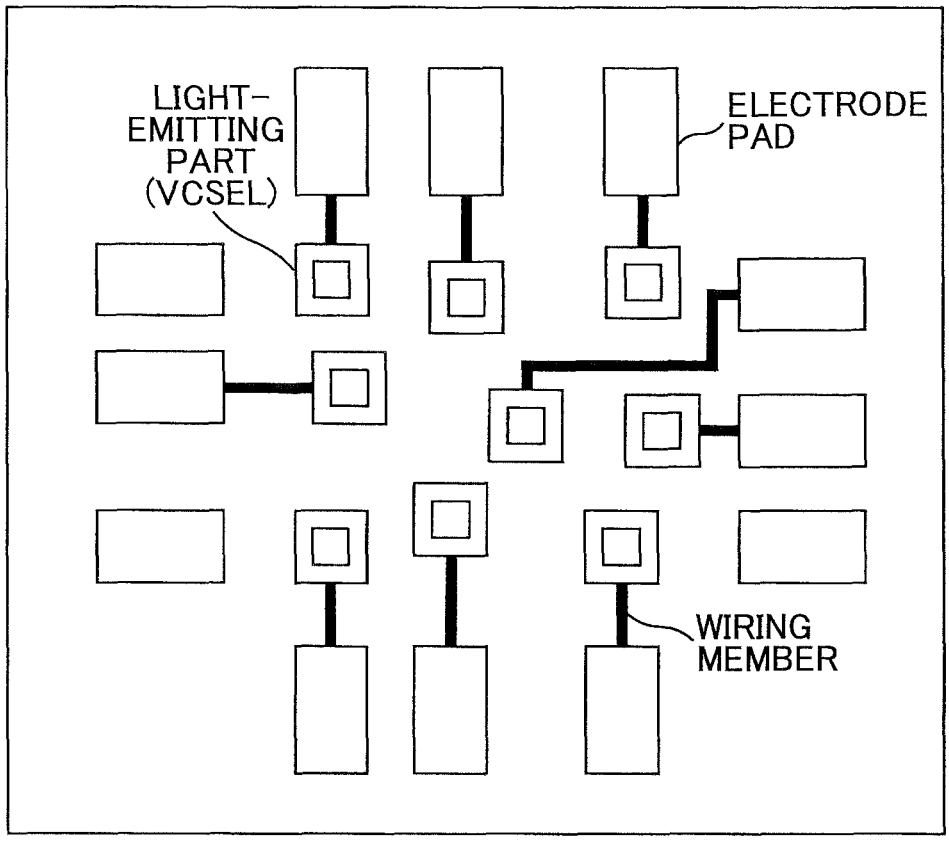
FIG. 14 is a diagram illustrating a surface-emitting laser array in which light-emitting parts are not evenly spaced apart.

Further, in the above described embodiment, the plural light-emitting parts in the surface-emitting laser array can be such that, at least for a portion of the light-emitting parts, the distance between the neighboring light-emitting parts is different from the distance between the neighboring light-emitting parts that are not included in the portion (cf. FIG. 14). In this case, regularity of the speckle pattern is perturbed and the contrast ratio of the speckle pattern is additionally reduced. Namely, it is preferable that the distances of the neighboring light-emitting parts be different from each other.

Figure 15:
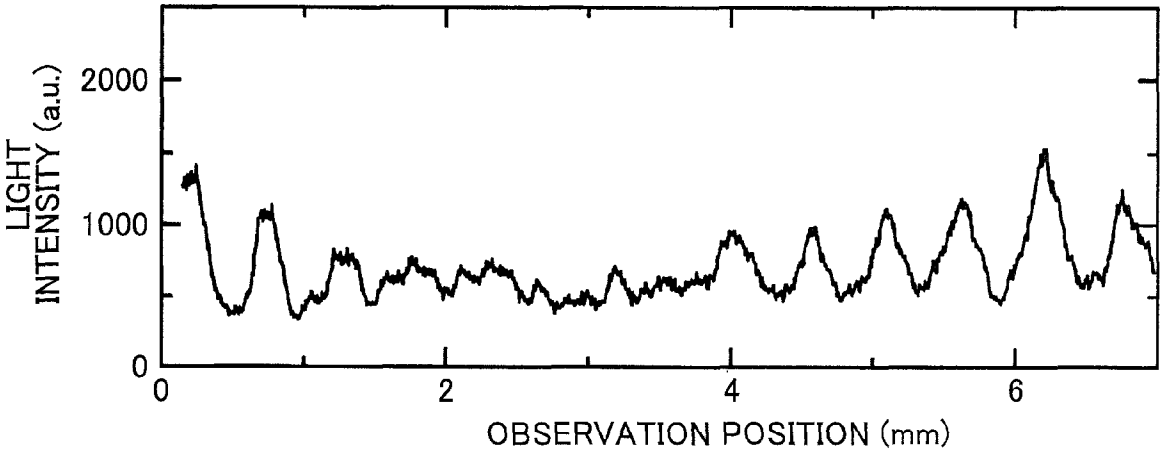
FIG. 15 is a diagram illustrating a light intensity distribution of the speckle pattern when the light-emitting parts are evenly spaced apart.

FIG. 15 shows a light intensity distribution which was obtained by observing the speckle pattern with the beam profiler, when all the distances between the neighboring light-emitting parts are set to be equal in the light source including the surface-emitting laser array, in which 5 light-emitting parts are arranged in a line. In this case, a periodic oscillation of the light intensity corresponding to the regularity of the arrangement of the light-emitting parts is observed and the contrast ratio is 0.64.

Figure 16:
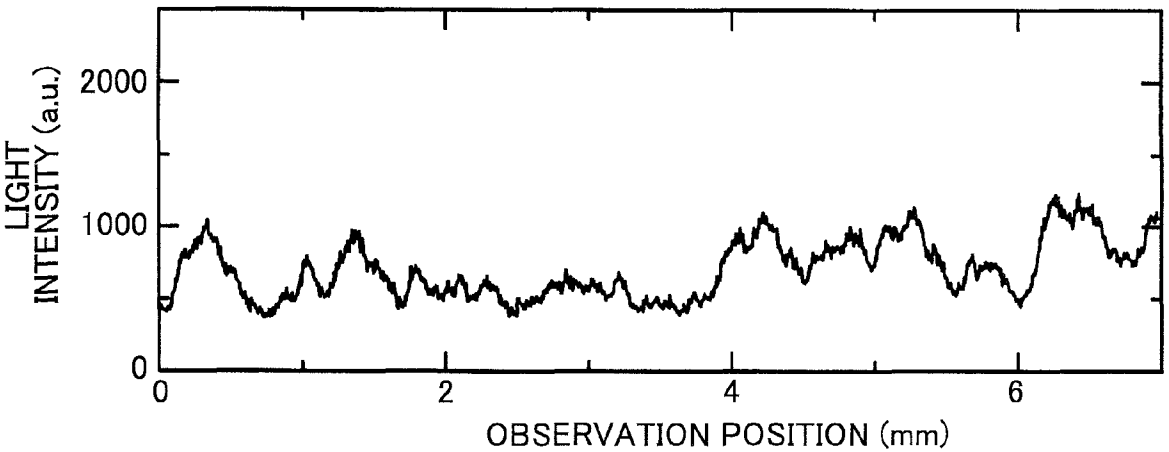
FIG. 16 is a diagram illustrating a light intensity distribution of the speckle pattern when the light-emitting parts are not evenly spaced apart.

FIG. 16 shows a light intensity distribution which was obtained by observing the speckle pattern with the beam profiler, when ratios of the distances between the neighboring light-emitting parts are set to be irregular, that is, 1.0:1.9:1.3:0.7, in the light source including the surface-emitting laser array, in which 5 light-emitting parts are arranged in line. In this case, the periodic oscillation of the light intensity is suppressed, and the contrast ratio is 0.56. The contrast ratio is reduced compared to the case when the distances between the light-emitting parts are equal.

Therefore, the speckle pattern can be further suppressed by arranging the plural light-emitting parts so that the distances between the neighboring light-emitting parts are not equal.

Figure 17:
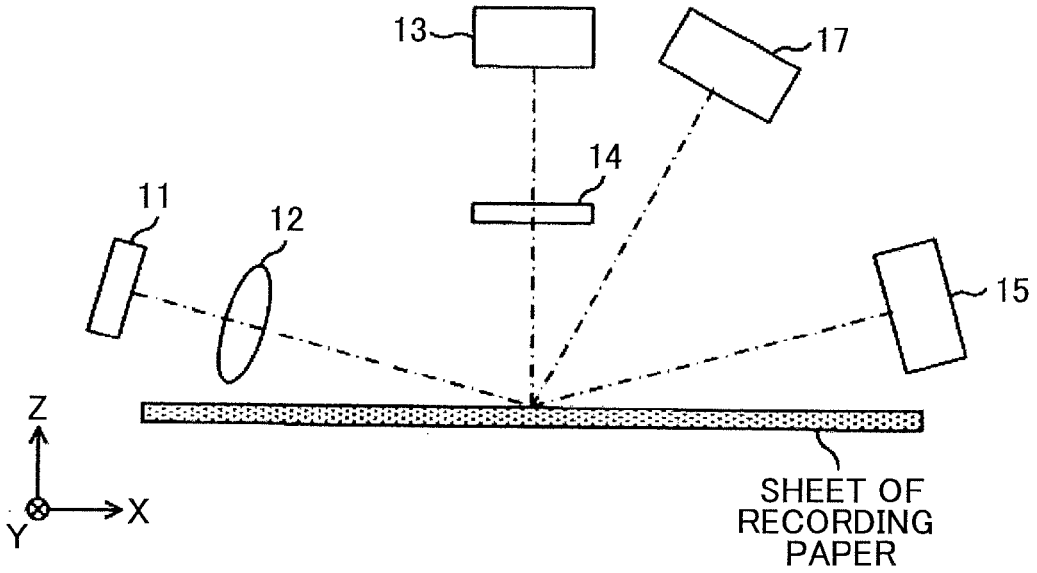
FIG. 17 is a first diagram illustrating a first modified example of the optical sensor.

Incidentally, if it is possible that the paper type is erroneously determined by an effect of ambient light or stray light, the optical detection system may be expanded. For example, as shown in FIG. 17, an optical receiver 17 may be additionally included. The optical receiver 17 is arranged at a position where the surface diffusely-reflected light and the internal diffusely-reflected light are detected.

Figure 18:
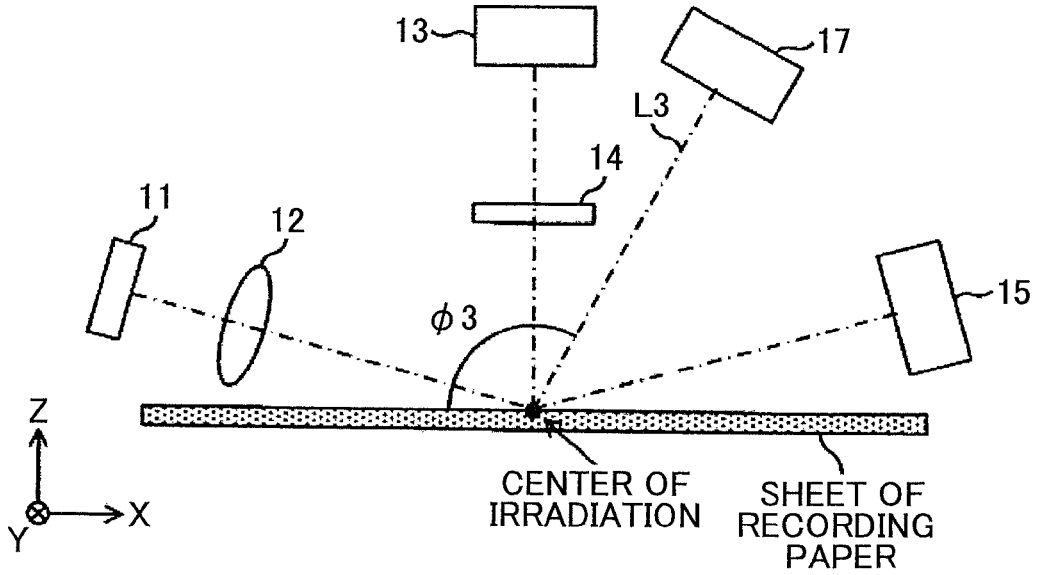
FIG. 18 is a second diagram illustrating the first modified example of the optical sensor.

In this case the center of the light source 11, the center of irradiation, the center of the polarization filter 14, the center of the optical receiver 13, the center of the optical receiver 15, and the center of the optical receiver 17 are substantially placed on the same plane. An angle $\phi$3 between a line L3 and the surface of the sheet of recording paper is 120 degrees (cf. FIG. 18). Here, the line L3 connects the center of irradiation and the center of the optical receiver 17.

Hereinafter, the paper type determination process performed in this case by the printer controlling device 2090 is explained. In the following, a signal level in the output signal from the optical receiver 17, when the light flux from the light source 11 is irradiated onto the sheet of recording paper, is referred to as "S3."

(1) The plural light-emitting parts of the optical sensor 2245 are simultaneously lighted.

(2) The values of S1, S2, and S3 are obtained from the output signals from the respective optical receivers.

(3) A value of S3/S2 is calculated.

(4) The table of determining sheets of recording paper is referred to, and the name of the sheet of recording paper is identified from the obtained values of S1 and S3/S2.

(5) The identified name of the sheet of recording paper is stored in the RAM, and the paper type determination process is terminated.

Here, with respect to plural names of sheets of recording paper, which the color printer 2000 can handle, the values of S1 and S3/S2 are measured in advance for the respective names of sheets of recording paper at a pre-shipment process, such as an adjustment process. The measured results are stored in the ROM of the printer controlling device 2090 as "the table of determining sheets of recording paper."

Figure 19:
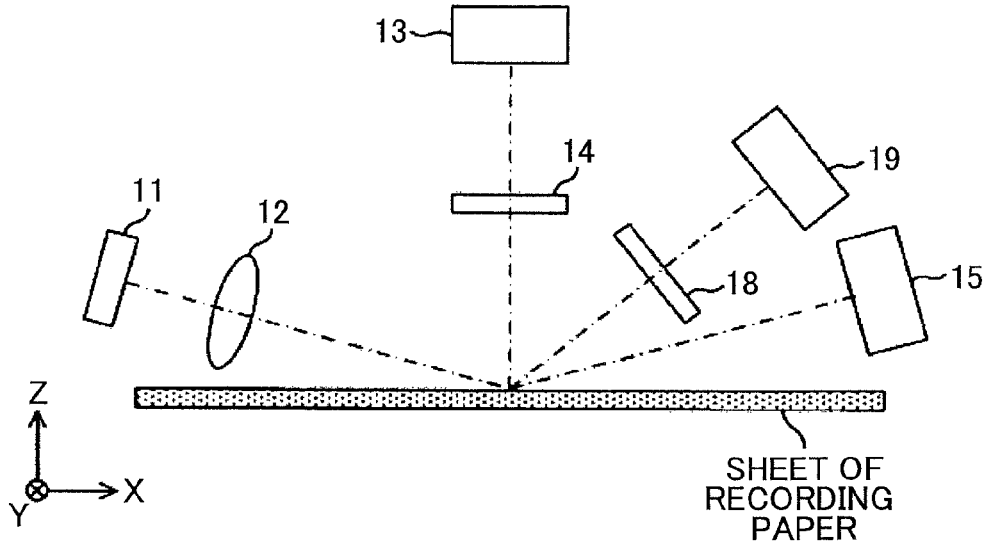
FIG. 19 is a first diagram illustrating a second modified example of the optical sensor.

Further, for example, as shown in FIG. 19, the polarization filter 18 and the optical receiver 19 may be additionally included.

The polarization filter 18 is placed on optical paths of the surface diffusely-reflected light and the internal diffusely-reflected light. The polarization filter 18 transmits the P-polarized light but blocks the S-polarized light. The optical receiver 19 is placed on an optical path of a light flux which has transmitted through the polarization filter 18. At the position, the optical receiver 19 receives the P-polarized light components included in the internal diffusely-reflected light.

Figure 20:
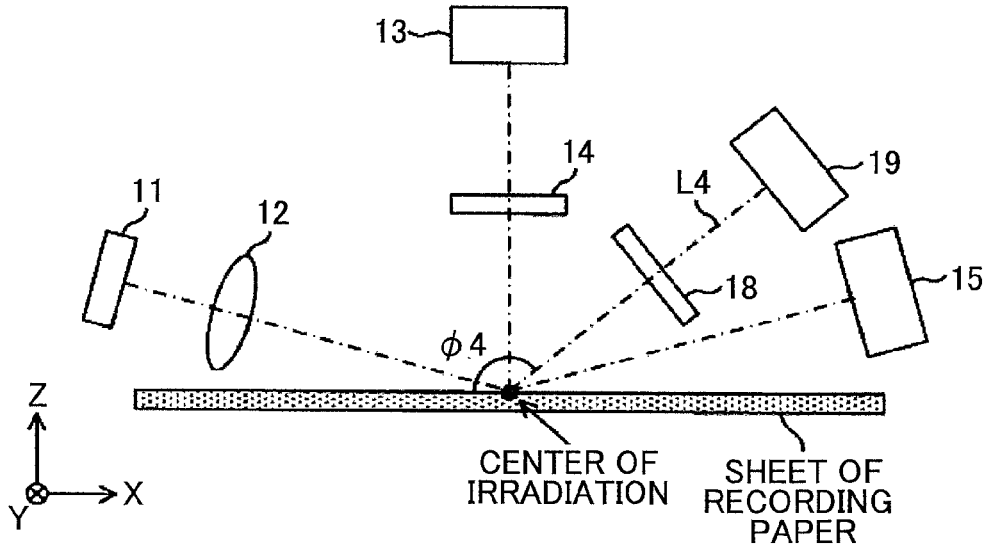
FIG. 20 is a second diagram illustrating the second modified example of the optical sensor.

In this case the center of the light source 11, the center of irradiation, the center of the polarization filter 14, the center of the optical receiver 13, the center of the optical receiver 15, the center of the polarization filter 18, and the center of the optical receiver 19 are substantially placed on the same plane. An angle $\phi$4 between a line L4 and the surface of the sheet of recording paper is 150 degrees (cf. FIG. 20). Here, the line L4 connects the center of irradiation, the center of the polarization filter 18, and the optical receiver 19.

Hereinafter, the paper type determination process performed in this case by the printer controlling device 2090 is explained. In the following, a signal level in the output signal from the optical receiver 19, when the light flux from the light source 11 is irradiated to the sheet of recording paper, is referred to as "S4."

(1) The plural light-emitting parts of the optical sensor 2245 are simultaneously lighted.

(2) The values of S1, S2, and S4 are obtained from the output signals from the respective optical receivers.

(3) A value of S4/S1 is calculated.

(4) The table of determining sheets of recording paper is referred to, and the name of the sheet of recording paper is identified from the obtained values of S4/S1 and S2.

(5) The identified name of the sheet of recording paper is stored in the RAM, and the paper type determination process is terminated.

Here, with respect to plural names of sheets of recording paper, which the color printer 2000 can handle, the values of S4/S1 and S2 are measured in advance for the respective names of sheets of recording paper at a pre-shipment process, such as an adjustment process. The measured results are stored in the ROM of the printer controlling device 2090 as "the table of determining sheets of recording paper."

Figure 21:
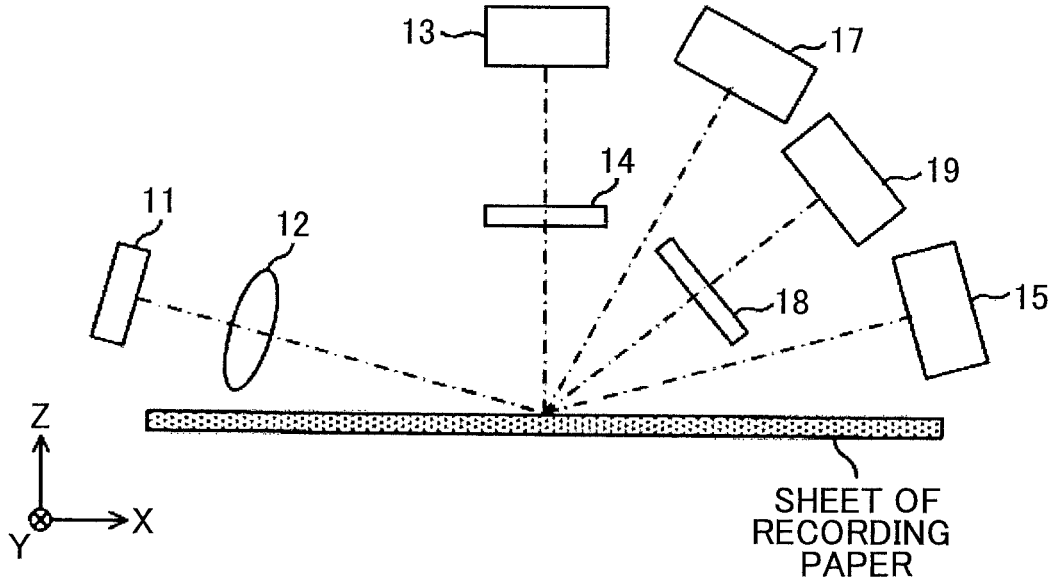
FIG. 21 is a first diagram illustrating a third modified example of the optical sensor.
Figure 22:
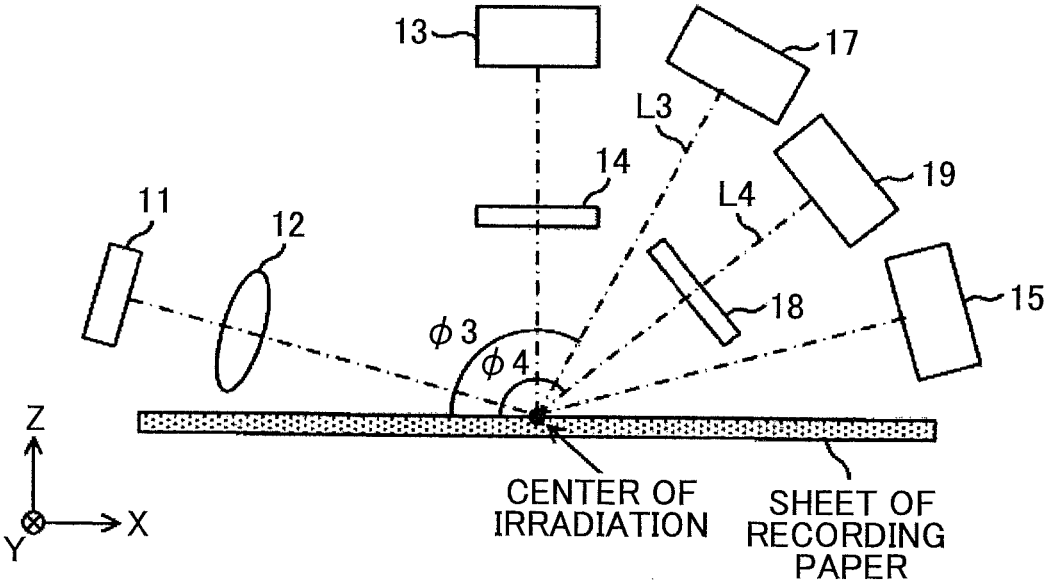
FIG. 22 is a second diagram illustrating the third modified example of the optical sensor.

Further, for example, as shown in FIGS. 21 and 22, the above described optical receiver 17, the above described polarization filter 18, and the above described optical receiver 19 may be additionally included. Namely, a third optical detection system including the optical receiver 19 and a fourth optical detection system including the polarization filter 18 and the optical receiver 19 may be additionally included.

Hereinafter, the paper type determination process performed in this case by the printer controlling device 2090 is explained.

(1) The plural light-emitting parts of the optical sensor 2245 are simultaneously lighted.

(2) The values of S1, S2, S3, and S4 are obtained from the output signals from the respective optical receivers.

(3) Values of S4/S1 and S3/S2 are calculated.

Figure 23:
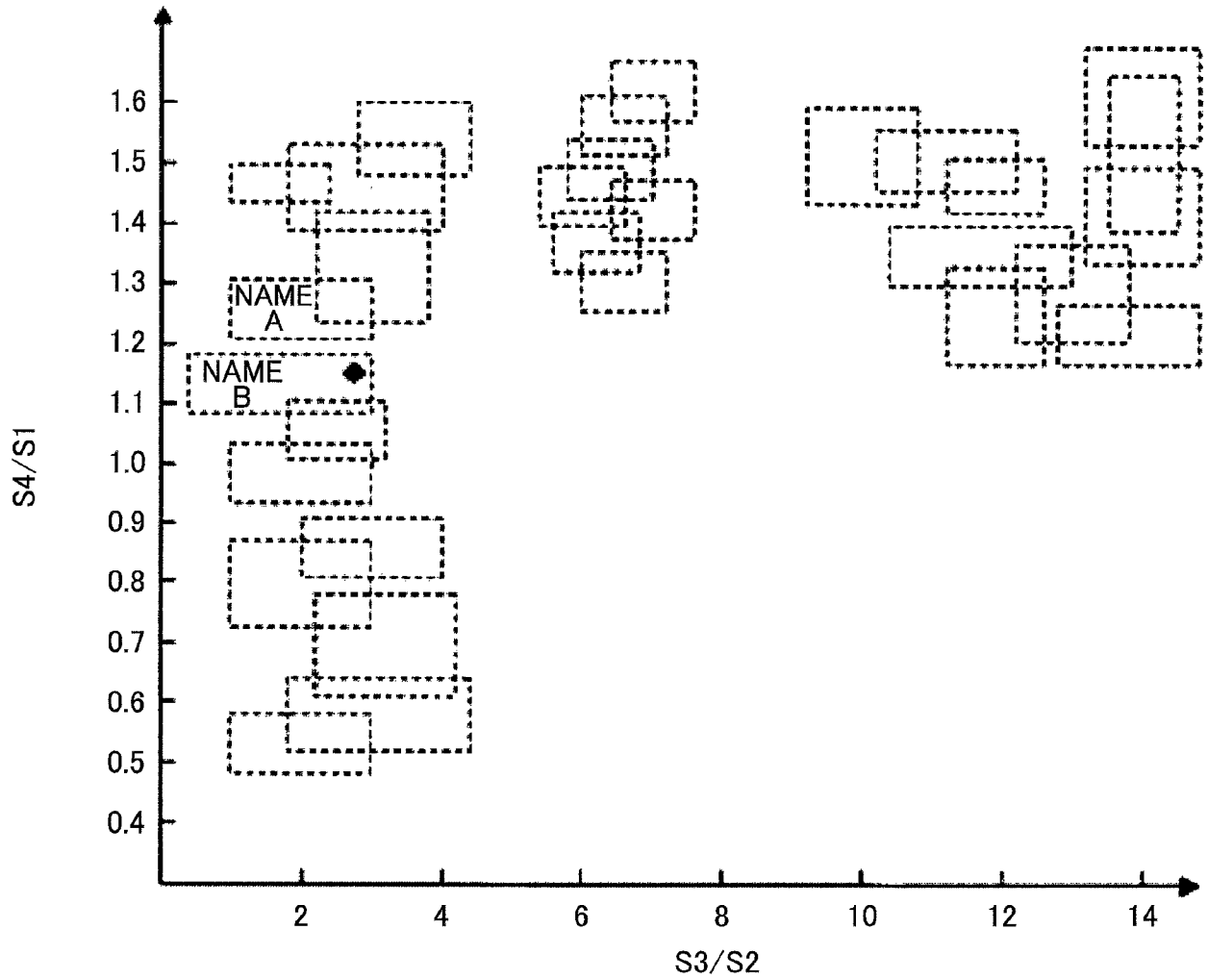
FIG. 23 is a diagram illustrating a relationship among S4/S1, S3/S2, and a name of the sheet of recording paper.

(4) The table of determining sheets of recording paper is referred to, and the name of the sheet of recording paper is identified from the obtained values of S4/S1 and S3/S2 (cf. FIG. 23).

(5) The identified name of the sheet of recording paper is stored in the RAM, and the paper type determination process is terminated.

Here, with respect to plural names of sheets of recording paper, which the color printer 2000 can handle, the values of S4/S1 and S3/S2 are measured in advance for the respective names of sheets of recording paper at a pre-shipment process, such as an adjustment process. The measured results are stored in the ROM of the printer controlling device 2090 as "the table of determining sheets of recording paper."

In this manner, by providing the plural optical receiving systems that detect the respective diffusion light beams reflected in the mutually different directions and determining the sheet of recording paper using the calculated values, such as the ratios of the values detected at the respective optical systems, an accurate determination is possible even if there are the ambient light and the stray light.

Further, in this case, the printer controlling device 2090 may roughly narrow down the types of the sheet of recording paper using S1 and S2, and then the printer controlling device 2090 may determine the name of the sheet of the recording paper using S4/S1 and S3/S2.

Here, S4/S1 is used as the calculation method using S1 and S4, but the calculation method is not limited to the use of S4/S1. Similarly, the calculation method using S2 and S3 is not limited to the use of S3/S2.

Figure 24A:
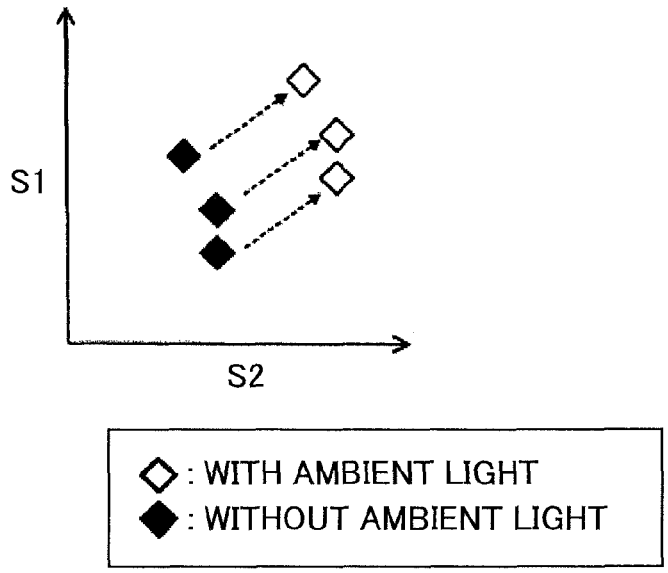
FIG. 24A and FIG. 24B are diagrams illustrating an influence of ambient light.
Figure 24B:
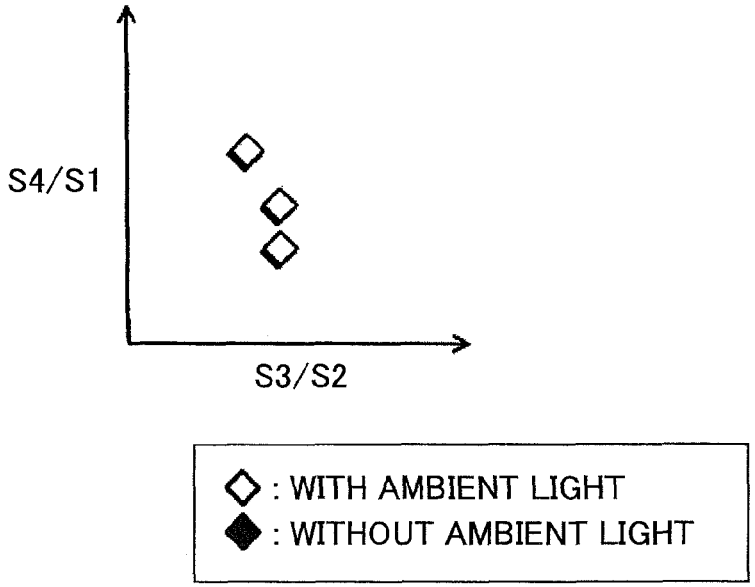

FIG. 24A and FIG. 24B show the examined results of the effect of the ambient light for the case in which the type of paper is determined using only S1 and S2 and for the case in which the type of paper is determined using S4/S1 and S3/S2, respectively. As is clear from FIG. 24A and FIG. 24B, when there is the ambient light, the detection values at the respective optical receiving systems are greater. Thus, for the case in which the type of paper is determined using only S1 and S2, it is possible that the type of paper is determined erroneously. On the other hand, when there is the ambient light and when the type of paper is determined using S4/S1 and S3/S2, S4/S1 and S3/S2 do not change from the case in which there is no ambient light. Thus the type of paper is determined correctly.

In this case, the above described third optical detection system may include plural optical receivers. Further, the above described forth optical detection system may include plural polarization filters and optical receivers.

For example, when the above described third optical detection system includes two optical receivers and the above described fourth optical detection system includes two sets of a polarization filter and an optical receiver, and when the output levels from the respective optical receivers of the third optical detection system are "S3" and "S5" and the output levels from the respective optical receivers of the fourth optical detection system are "S4" and "S6," the type of paper may be determined using the values of (S4/S1+S6/S1) and (S3/S2+S5/S2). Further, the type of paper may be determined using the values of S4/S1, S6/S1, S3/S2, and S5/S2.

Further, "the table of determining sheets of recording paper" corresponding to the calculation method used for the paper type determination has been produced at a pre-shipment process, such as an adjustment process, and stored in the ROM of the printer controlling device 2090.

Figure 25:
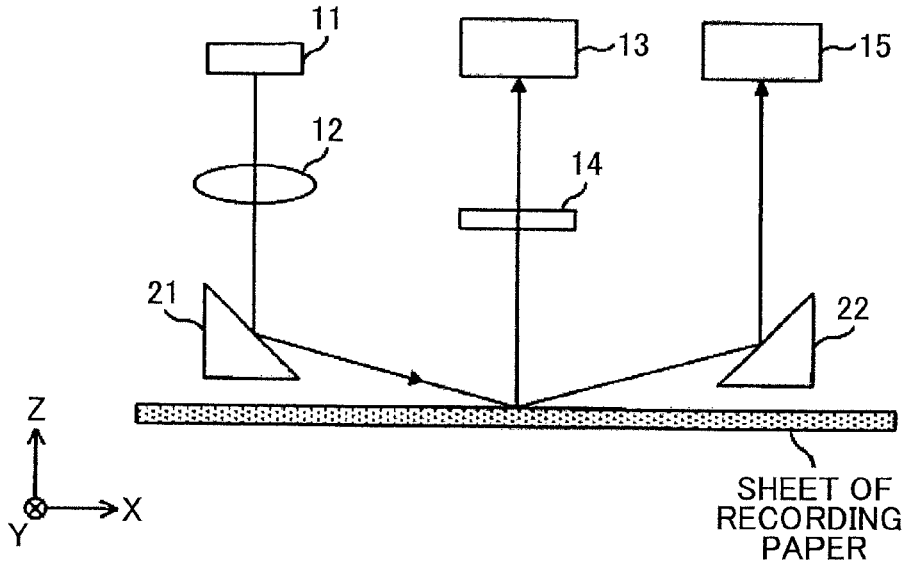
FIG. 25 is a diagram illustrating a fourth modified example of the optical sensor.

Further, in the above described embodiment, the optical sensor 2245 may additionally include two mirrors (21, 22), for example, as shown in FIG. 25. Here, the optical source 11 emits an optical flux in a direction parallel to the Z-axis, and the collimation lens 12 is arranged so that the optical axis is parallel to the Z-axis.

Then a mirror 21 bends the optical path of the light flux, which has passed through the collimation lens 12, so that an incident angle of the light flux at the sheet of recording paper is 80 degrees.

A mirror 22 is an equivalent mirror to the mirror 21. The mirror 22 is arranged at a position facing to the mirror 21 through an opening section, with respect to the X-axis direction. The optical path of the surface specular reflected light from the sheet of recording paper is bent at the position by the mirror 22 so that a traveling direction of the surface specular reflected light is parallel to the Z-axis.

Further, the optical receiver 15 is placed at the positive side in the Z-axis direction of the mirror 22. The optical receiver 15 receives the surface specular reflected light whose light path has been bent by the mirror 22.

In this case, members supporting the light source and the optical receiver, the light source and the optical receiver being in an inclined state, are not required, and an electric circuit can be simplified. In this manner, an optical sensor, which can be downsized, can be realized at a low cost.

Further, when more than three optical receivers are provided, by setting the travelling directions of light fluxes toward the respective optical receivers to be a direction parallel to the Z-axis direction, the downsizing of the optical sensor can be facilitated.

Further, in the above embodiment, the case in which the light source 11 includes the plural light-emitting parts is explained. However, the embodiment is not limited to this, and the light source 11 may include a single light-emitting part.

Figure 26:
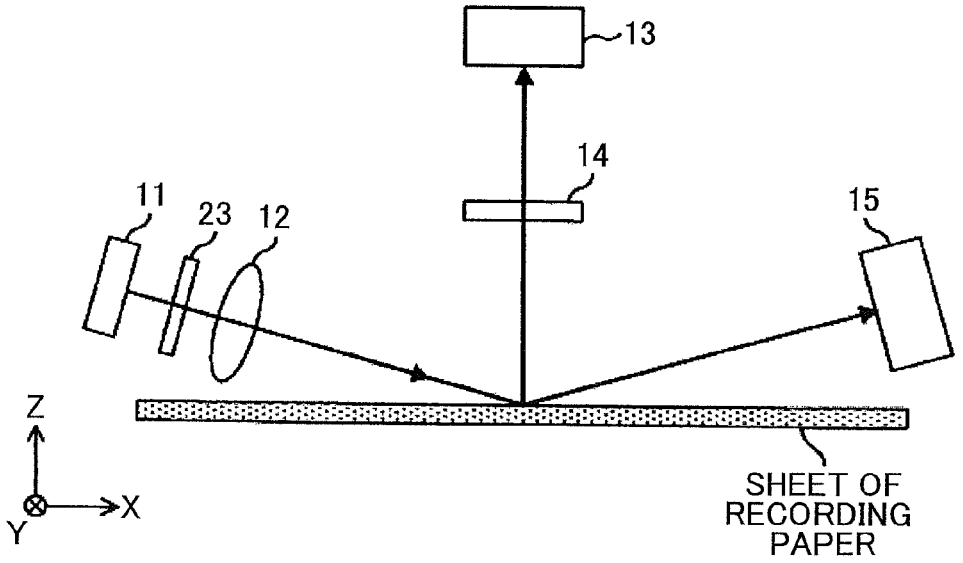
FIG. 26 is a diagram illustrating a fifth modified example of the optical sensor.

Additionally, in the above described embodiment, a conventional LD (Laser Diode) may be used instead of the above described surface-emitting laser array. However, in this case, as shown in FIG. 26 as an example, a polarization filter 23, which causes the irradiated light to be the S-polarized light, may be required.

In the above embodiment, the case in which there is one feeding tray is explained. However, the embodiment is not limited to this, and there may be plural feeding trays. In this case, one of the optical sensors 2245 may be provided for each feeding tray.

Additionally, in the above embodiment, the name of the sheet of recording paper can be identified during conveyance of the sheet of recording paper. In this case, the optical sensor 2245 is arranged in the neighborhood of the conveyance path. For example, the optical sensor 2245 may be arranged in the neighborhood of the conveyance path between the above described feeding roller 2054 and the above described pair of registration rollers 2056.

Further, the optical sensor 2245 may be applied to an image forming apparatus which forms an image by spraying ink onto the sheet of recording paper.

Figure 27:
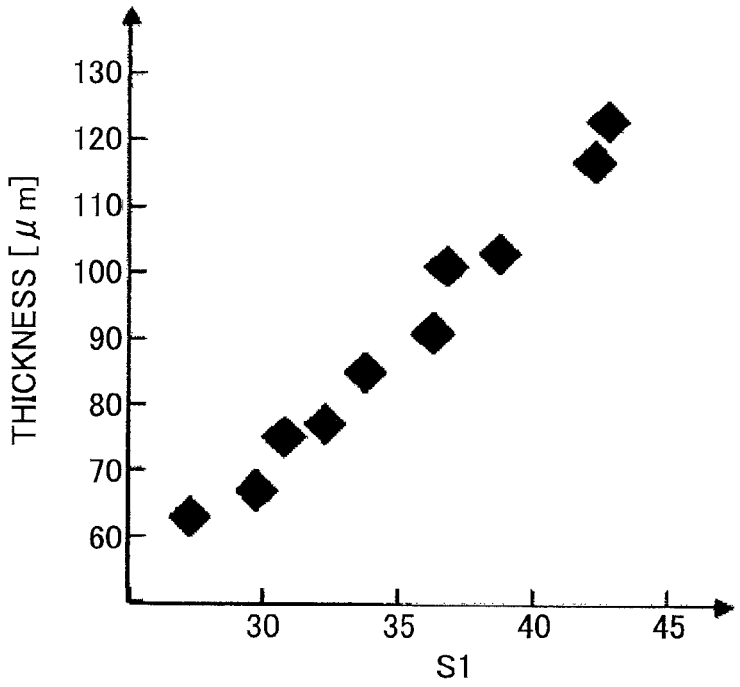
FIG. 27 is a diagram illustrating a relationship between thickness and S1.

Further, it is possible to apply the optical sensor 2245 to detect the thickness of an object (cf. FIG. 27). Some of conventional thickness sensors are configured to be a transmission type. It may be required to place optical systems in both directions of the object so that they are pinching the object. Thus a supporting member may be required. On the other hand, the optical sensor 2245 may detect the thickness only with the reflected light. Thus, it suffices to place the optical system only at one side of the object. Therefore, the number of the components can be reduced, and the cost and size may be reduced. The optical sensor 2245 is very suitable for placement inside the image forming apparatus, which is required to detect the thickness of the object.

Figure 28:
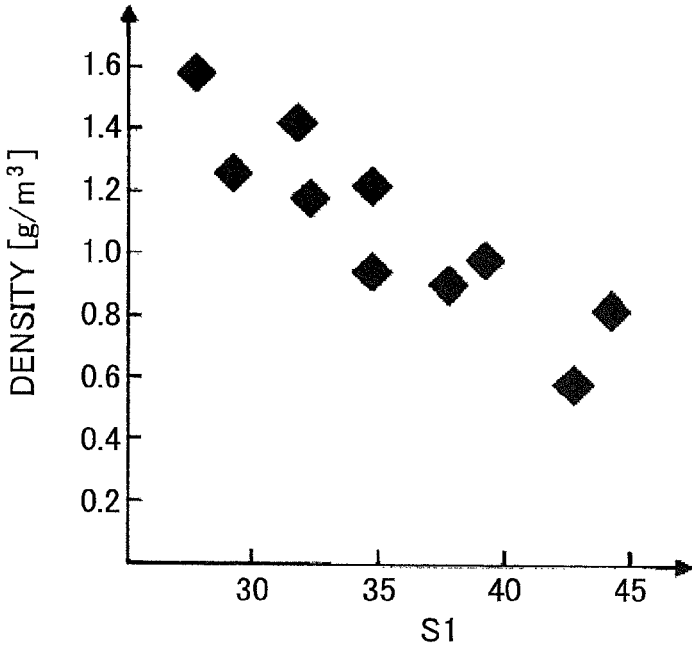
FIG. 28 is a diagram illustrating a relationship between density and S1.

Further, it is possible to apply the optical sensor 2245 to detect the density of an object (cf. FIG. 28). Some of conventional thickness sensors are configured to be a transmission type. It may be required to place the optical systems in both directions of the object so that they are pinching the object. Thus the supporting member may be required. On the other hand, the optical sensor 2245 detects the density only with the reflected light. Thus, it suffices to place the optical system only at one side of the object. Therefore, the number of the components can be reduced, and the cost and size may be reduced. The optical sensor 2245 is very suitable for placement inside the image forming apparatus, which is required to detect the density of the object.

Further, in the above described embodiment, it is preferable that a condensing lens be placed in front of each of the optical receivers. In this case, a variation in the amount of detected light may be reduced.

For the optical sensor that determines the sheet of recording paper based on the amount of reflected light, reproducibility of the measurement is important. In the optical sensor determining the sheet of recording paper based on the amount of reflected light, the measurement system is arranged assuming that the surface to be measured and the surface of the sheet of recording paper are on the same plane at the time of the measurement. However, it is possible that the surface of the sheet of recording paper is slanted or floating with respect to the surface to be measured because of some reason, such as a deflection or an oscillation. Thus a case may arise in which the surface of the sheet of recording paper is not on the same plane as the surface to be measured. In this case, the amount of reflected light varies, and a stable and detailed determination is difficult. Here, a specular reflection is described as an example.

Figure 29A:
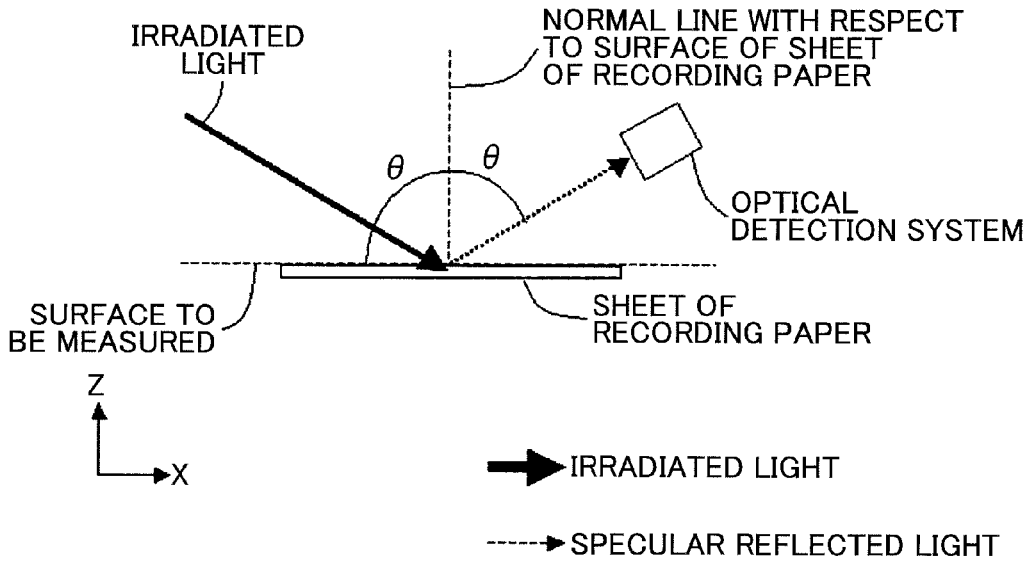
FIG. 29A-FIG. 29C are diagrams illustrating a change in an amount of detected light caused by a displacement between a surface to be measured and a surface of the sheet of recording paper, respectively.

FIG. 29A shows a case in which the surface to be measured and the surface of the sheet of recording paper are in the same plane. In this case, an optical detection system can receive the specular reflected light.

Figure 29B:
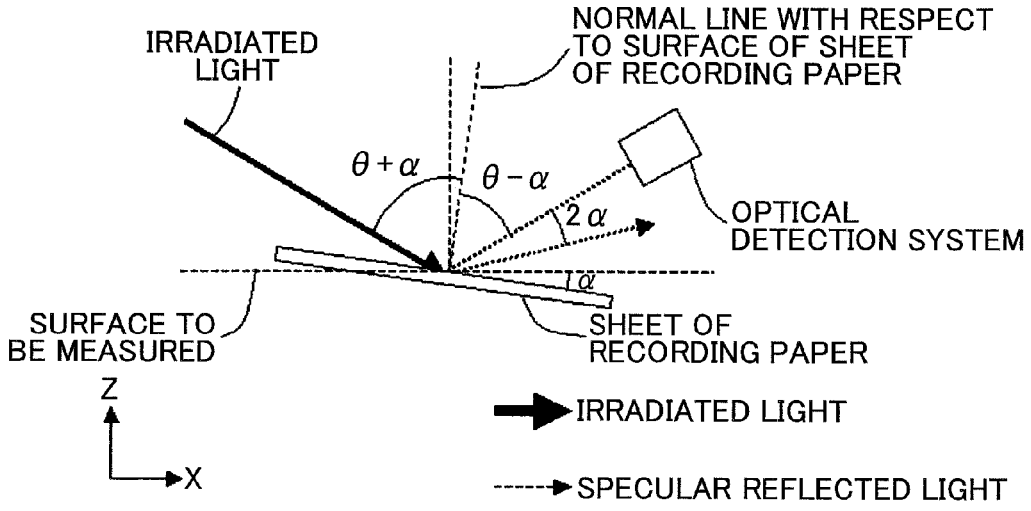

FIG. 29B shows a case in which the surface of the sheet of recording paper is slanted by an angle $\alpha$ with respect to the surface to be measured. In this case, when the positional relationship between an optical irradiation system and the optical detection system is the same as that of the case of FIG. 29A, the optical detection system receives the reflected light in a direction which is shifted by an angle of $2\alpha$ from the direction of specular reflection. Since a light intensity distribution of the reflected light is displaced in accordance with the shift, if a on distance between a center position of the irradiated area and the optical detection system is L, then the optical detection system receives the reflected light at a position which is shifted from a position, at which the specular reflected light is received, by $L \times \tan 2\alpha$. Further, the actual incident angle is shifted from a defined incident angle $\theta$ by the angle $\alpha$, and the reflection ratio from the sheet of recording paper varies. Therefore, the amount of the detected light is changed. Consequently, the detailed determination is difficult.

Figure 29C:
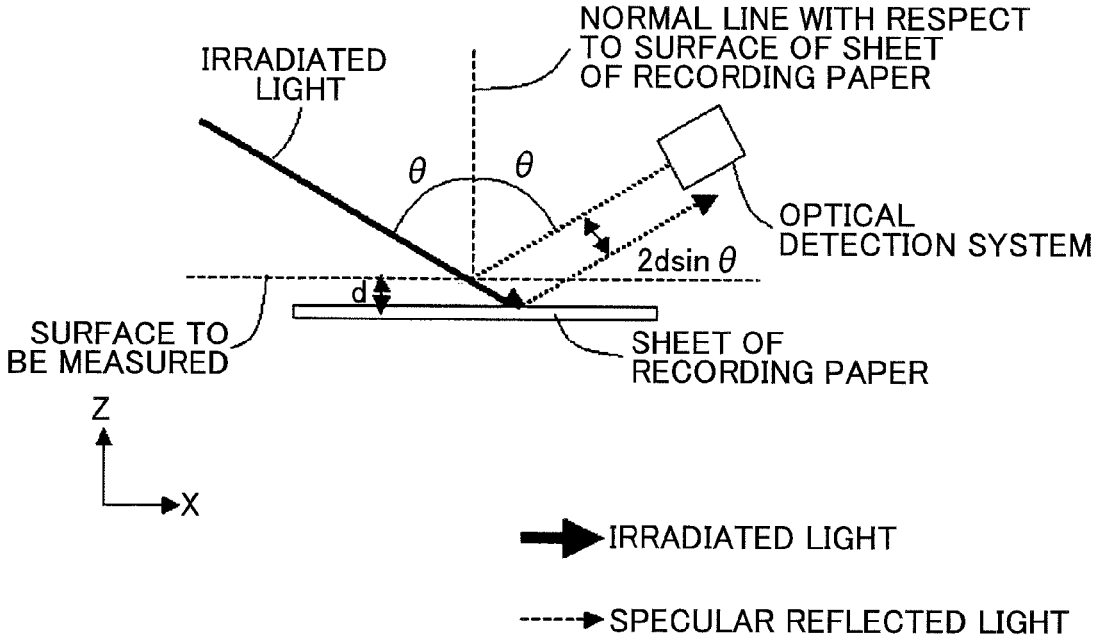

Further, FIG. 29C shows a case in which the surface of the sheet of recording paper is shifted by d in a height direction, that is, the Z-axis direction, from the surface to be measured. In this case, when the positional relationship between the optical irradiation system and the optical detection system is the same as that of the case of FIG. 29A, since the light intensity distribution of the reflected light is displaced in accordance with the shift, the optical detection system receives the reflected light at a position which is shifted from the position, at which the specular reflected light is received, by $2d \times \sin \theta$. Therefore, the amount of the detected light is changed. Consequently, the on detailed determination is difficult.

The cases of FIG. 29B and FIG. 29C can be handled by placing the condensing lens in front of the optical detection system against the amount of the shift, so as to ensure that the optical detection system detects the specular reflected light, and so that the reflected light is collected even if the light intensity distribution of the reflected light is displaced.

Alternatively, it is possible to eliminate the inconvenience that the surface of the sheet of recording paper and the surface to be measured are not the same plane, by using a photodiode (PD), whose light receiving area is sufficiently large, in the optical receiver, or by narrowing the diameter of the irradiated light beam.

Further, a photodiode array can be used in the optical receiver, so that the optical receiver has a sufficiently large light receiving area against the displaced amount of the light intensity distribution of the reflected light. In this case, the maximum signal among the signals detected by the respective PDs can be set to be the signal of the specular reflected light. Further, when the photodiodes are arrayed, the variation in the output caused by the displacement of the specular reflected light and the center of the light receiving area can be reduced, when the size of the light receiving area of each photodiode is reduced. Thus, a more precise detection can be performed.

Here, the specular reflection is described for the sake of simplicity. However, the variations in the amount of detected light caused by the displacement between the surface to be detected and the surface of the sheet of recording paper arise for the surface diffusely-reflected light and the internal diffusely-reflected light. The cases can be handled similarly to the case of the specular reflection.

Further, in the above described embodiment, a processing device may be included in the optical sensor 2245 (cf. FIG. 2B), and a part of the process in the printer controlling device 2090 may be processed in the processing device.

Further, the object to be identified by the optical sensor 2245 is not limited to the printing paper.

Further, in the above described embodiment, the optical sensor 2245 may be arranged such that the optical sensor determines the sheet of recording paper stored in the feeding tray 2060.

In the above described embodiment, the case in which the image forming apparatus is the color printer 2000 is explained. However, the embodiment is not limited to this. For example, the image forming apparatus can be an optical plotter or a digital copier. Further, the image forming apparatus can be an image forming apparatus which directly sprays ink on the surface of the sheet of recording paper and forms an image.

Furthermore, in the above embodiment, the case in which the image forming apparatus includes four photosensitive drums is explained. However, the embodiment is not limited to this.

The present invention is not limited to the specifically disclosed embodiments, and variations and modifications may be made without departing from the scope of the present invention.

The present application is based on Japanese Priority Application Nos. 2010-263093 and 2011-167948 filed on Nov. 26, 2010 and Aug. 1, 2011, respectively, the entire contents of which are hereby incorporated herein by reference.

What is claimed is:

1. An optical sensor comprising:

an irradiation system including a semiconductor laser having a plurality of light-emitting parts that are two-dimensionally arranged and that emit a plurality of corresponding light beams, wherein the irradiation system irradiates a plurality of fluxes of light including the plurality of light beams simultaneously emitted by the corresponding two-dimensionally arranged light-emitting parts of the semiconductor laser; and a photodetector configured to detect an amount of light of the plurality of fluxes of light that are two-dimensionally arranged and include the plurality of light beams simultaneously emitted by the corresponding two-dimensionally arranged light-emitting parts of the semiconductor laser and reflected on a sheet-like object, wherein a number of the light-emitting parts of the semiconductor laser which are simultaneously emitting the light beams is more than 1, and a speckle pattern is suppressed as compared to a case of a single light-emitting part.

2. The optical sensor according to claim 1, wherein the semiconductor laser is a vertical-cavity surface-emitting laser.

3. The optical sensor according to claim 1, wherein, with respect to one direction, a distance between any two neighboring light-emitting parts included in a subset of the plural light-emitting parts is different from a distance between any two neighboring light-emitting parts not included in the subset.

4. The optical sensor according to claim 1, further comprising:

a wavelength changing unit that causes a wavelength of the light emitted from the semiconductor laser to vary with respect to time.

5. The optical sensor according to claim 4, wherein the wavelength changing unit causes the wavelength of the light emitted from the semiconductor laser to vary with respect to time by changing an amount of a driving current supplied to the semiconductor laser with respect to time.

6. The optical sensor according to claim 1, wherein the at least one photodetector includes a first photodetector and a second photodetector;

the first photodetector is placed on a light path of specular reflected light which is the light regularly reflected on the object;

the second photodetector is placed on a light path of diffusely-reflected light which is the light diffusely-reflected on the object within an incidence plane of the object;

the light emitted from the irradiation system is linearly-polarized light which is polarized in a first polarization direction; and the optical sensor includes an optical element which is placed on the light path of the diffusely-reflected light, the diffusely-reflected light traveling toward the second photodetector, wherein the optical element transmits linearly-polarized light which is polarized in a second polarization direction perpendicular to the first polarization direction.

7. The optical sensor according to claim 6, further comprising:

a third photodetection system including at least one photodetector placed on a light path of diffusely-reflected light which is the light diffusely-reflected on the object within the incidence plane of the object; and a processing unit configured to identify the object based on an output from the second photodetector and a ratio between an output from the at least one photodetector of the third photodetection system and an output from the first photodetector.

8. The optical sensor according to claim 6, further comprising:

a third photodetection system including at least one optical element placed on a light path of diffusely-reflected light which is the light diffusely-reflected on the object within the incidence plane of the object, the at least one optical element transmitting the linearly-polarized light which is polarized in the second polarization direction, and at least one photodetector that receives light that is transmitted through the at least one optical element; and a processing unit configured to identify the object based on an output from the first photodetector and a ratio between an output from the at least one photodetector of the third photodetection system and an output from the second photodetector.

9. The optical sensor according to claim 6, further comprising:

a third photodetection system including at least one photodetector placed on a light path of diffusely-reflected light which is the light diffusely-reflected on the object within the incidence plane of the object;

a fourth photodetection system including at least one optical element placed on a light path of diffusely-reflected light which is the light diffusely-reflected on the object within the incidence plane of the object, the at least one optical element transmitting the linearly-polarized light which is polarized in the second polarization direction, and at least one photodetector that receives light that is transmitted through the at least one optical element; and a processing unit configured to identify the object based on a ratio between an output from the at least one photodetector of the third photodetection system and an output from the first photodetector and a ratio between an output from the at least one photodetector of the fourth photodetection system and an output from the second photodetector.

10. The optical sensor according to claim 1, wherein the irradiation system includes a light source and a light path changing element that bends a light path of a light flux in an incident direction.

11. The optical sensor according to claim 1, further comprising:

a light path changing element that bends a light path of light, the light being reflected on the object, in a direction toward the at least one photodetector.

12. The optical sensor according to claim 1, further comprising:

a processing device configured to identify the object based on a detection result of the at least one photodetector.

13. An image forming apparatus that forms an image on a recording medium, the image forming apparatus comprising an optical sensor, the optical sensor comprising:

an irradiation system including a semiconductor laser having a plurality of light-emitting parts that are two-dimensionally arranged and that emit a plurality of corresponding light beams, wherein the irradiation system irradiates a plurality of fluxes of light including the plurality of light beams simultaneously emitted by the corresponding two-dimensionally arranged light-emitting parts of the semiconductor laser; and a photodetector configured to detect an amount of light of the plurality of fluxes of light that are two-dimensionally arranged and include the plurality of light beams simultaneously emitted by the corresponding two-dimensionally arranged light-emitting parts of the semiconductor laser and reflected on a sheet-like object, wherein a number of the light-emitting parts of the semiconductor laser which are simultaneously emitting the light beams is more than 1, and a speckle pattern is suppressed as compared to a case of a single light-emitting part.

14. The image forming apparatus according to claim 13, further comprising:

an adjusting device configured to identify a name of the recording medium based on an output from the at least one photodetector and configured to adjust an image formation condition in accordance with the identified name.

15. The image forming apparatus according to claim 13, further comprising:

an adjusting device configured to identify a degree of smoothness of the recording medium based on an output from the at least one photodetector and configured to adjust an image formation condition in accordance with the identified degree of smoothness.

16. The image forming apparatus according to claim 13, further comprising:

an adjusting device configured to identify a thickness of the recording medium based on an output from the at least one photodetector and configured to adjust an image formation condition in accordance with the identified thickness.

17. The image forming apparatus according to claim 13, further comprising:

an adjusting device configured to identify a density of the recording medium based on an output from the at least one photodetector and configured to adjust an image formation condition in accordance with the identified density.

18. The image forming apparatus according to claim 13, further comprising:

a collimation lens configured to convert the plurality of light fluxes that are two-dimensionally arranged into substantially parallel light fluxes so as to cause an incident angle to be a constant angle.

19. The optical sensor according to claim 1, further comprising:

a collimation lens configured to convert the plurality of light fluxes that are two-dimensionally arranged into substantially parallel light fluxes so as to cause an incident angle to be a constant angle.

* * * * *